US009190735B2

(12) United States Patent
Xu et al.

(10) Patent No.: US 9,190,735 B2
(45) Date of Patent: Nov. 17, 2015

(54) SINGLE-FEED MULTI-CELL METAMATERIAL ANTENNA DEVICES

(75) Inventors: Nan Xu, Carlsbad, CA (US); Norberto Lopez, San Diego, CA (US); Vaneet Pathak, San Diego, CA (US); Ajay Gummalla, San Diego, CA (US)

(73) Assignee: Tyco Electronics Services GmbH (CH)

( * ) Notice: Subject to any disclaimer, the term of this patent is extended or adjusted under 35 U.S.C. 154(b) by 1745 days.

(21) Appl. No.: 12/408,642

(22) Filed: Mar. 20, 2009

(65) Prior Publication Data

US 2009/0251385 A1 Oct. 8, 2009
US 2010/0109972 A2 May 6, 2010

Related U.S. Application Data

(60) Provisional application No. 61/042,699, filed on Apr. 4, 2008, provisional application No. 61/053,616, filed on May 15, 2008.

(51) Int. Cl.
*H01Q 1/38* (2006.01)
*H01Q 15/00* (2006.01)

(52) U.S. Cl.
CPC ..... *H01Q 15/008* (2013.01)

(58) Field of Classification Search
None
See application file for complete search history.

(56) References Cited

U.S. PATENT DOCUMENTS 6,157,344 A * 12/2000 Bateman et al. ..... 343/700 MS
6,741,213 B2 * 5/2004 Jenwatanavet ..... 343/700 MS
6,859,114 B2 2/2005 Eleftheriades et al.
6,930,640 B2 * 8/2005 Chung et al. ..... 343/700 MS
7,330,090 B2 2/2008 Itoh
7,391,288 B1 6/2008 Itoh
7,446,712 B2 11/2008 Itoh
7,482,893 B2 1/2009 Itoh
2002/0030626 A1 * 3/2002 Nagumo et al. ..... 343/700 MS
2003/0156064 A1 * 8/2003 Bancroft et al. ..... 343/700 MS
2004/0246653 A1 * 12/2004 Williams ..... 361/277
2005/0253667 A1 11/2005 Itoh
2006/0017621 A1 * 1/2006 Okawara et al. ..... 343/700 MS
2007/0285321 A1 * 12/2007 Chung et al. ..... 343/702
2008/0048917 A1 * 2/2008 Achour et al. ..... 343/700 MS
2008/0204327 A1 8/2008 Lee et al.
2008/0258981 A1 10/2008 Achour et al.
2009/0128446 A1 5/2009 Gummalla et al.
2009/0135087 A1 5/2009 Gummalla et al.

FOREIGN PATENT DOCUMENTS

CN 1879257 A 12/2006
CN 102057536 B 8/2014
WO 2007127955 11/2007
WO WO-2009145983 A2 12/2009

OTHER PUBLICATIONS

"Capacitors and Capacitance," John D. Kraus, Electromagnetics, Second Edition, McGraw Hill, 1973.*

(Continued)

*Primary Examiner* — Graham Smith

(57) ABSTRACT

Designs and techniques of Composite Right-Left Handed (CRLH) Metamaterial (MTM) antenna devices, including a CRLH MTM devices that include MTM cells formed on a substrate and a conductive launch stub formed on the substrate to be adjacent to each of the MTM cells and electromagnetically coupled to each of the MTM cells.

14 Claims, 31 Drawing Sheets

(56) References Cited

OTHER PUBLICATIONS

"Impedance and Admittance," Basic Engineering Circuit Analysis, 7th Edition, A Wiley First Edition, Irwin, John Wiley and Sons, 2002.*
"Electric Potential ofC harge Distributions and the Principle of Superposition of Potential," Electromagnetics, 2nd Edition, Kraus et al, 1973.*
"Antenna Theory: A Review," Balanis, Proc. IEEE vol. 80 No. 1 Jan. 1992.*
Herraiz-Martinez, Francisco J. et al., "Multi-frequency microstrip patch antennas based on metamaterial structures", IEEE Antennas and Propagation Society International Symposium 2007, Jun. 9-15, 2007, Honolulu, HI USA Jun. 2007 , 3484-3487.
Lai, A. et al., "Infinite Wavelength Resonant Antennas with Monopolar Radiation Pattern Based on Periodic Structures", IEEE Transactions on Antennas and Propagation, vol. 55(3) Mar. 2007 , 868-876.
Wu, Chien-Hung et al., "A novel small planar antenna utilizing cascaded right/left-handed transmission lines", IEEE Antennas and Propagation Society International Symposium 2007, Jun. 9-15, 2007, Honolulu, HI USA Jun. 2007 , 1889-1892.
International Search Report and Written Opinion dated Dec. 4, 2009 for International Application No. PCT/US2009/038129 filed Mar. 24, 2009 (11 pages).
Caloz and Itoh, "Electromagnetic Metamaterials: Transmission Line Theory and Microwave Applications," John Wiley & Sons (2006).
Tatsuo Itoh in "Invited paper: Prospects for Metamaterials," Electronics Letters, vol. 40, No. 16 (Aug. 2004).
Lai et al., "Infinite Wavelength Resonant Antennas with Monopolar Radiation Pattern Based on Periodic Structures," IEEE Trans. on Antennas and Propagation, vol. 55, No. 3, pp. 868-876, Mar. 2007.
U.S. Provisional U.S. Appl. No. 61/039,407, filed Mar. 25, 2008, entitled "Advanced Active Metamaterial Antenna Systems" by Gummalla et al.
"Korean Application Serial No. 2010-7023189, Office Action mailed Apr. 19, 2012", w/ English Translation, 7 pgs.
"Korean Application Serial No. 2010-7023139, Office Action mailed Sep. 27, 2011", 5 pgs.
"Chinese Application Serial No. 200980121066.3, Office Action mailed Feb. 20, 2013", (w/ English Translation), 6 pgs.
Chinese Application Serial No. 200980121066.3, Office Action mailed Nov. 21, 2013, 8 pgs.
Chinese Application Serial No. 200980121066.3, Response filed Feb. 7, 2014 to Office Action mailed Nov. 21, 2013, 6 pgs.

* cited by examiner

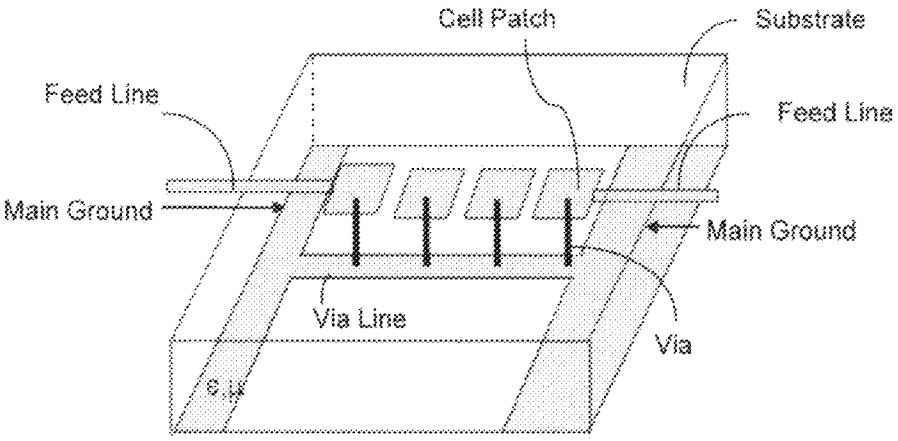
FIG. 8
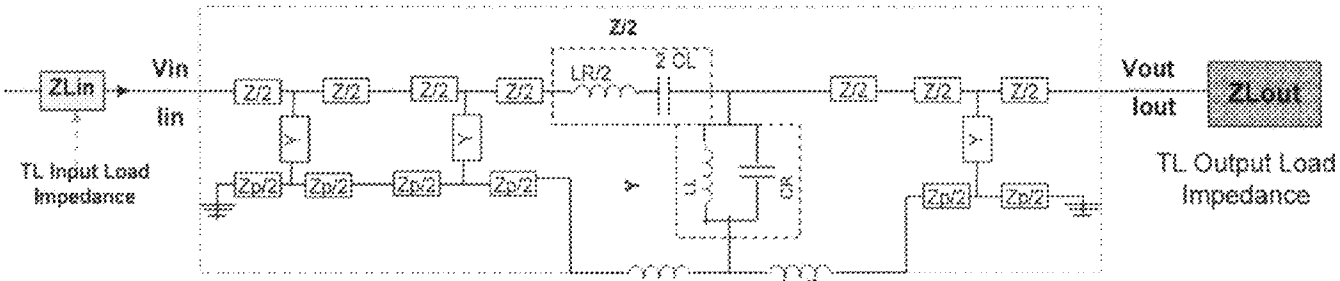
Vout
Iout
ZLout
TL Output Load Impedance
Z/2
Z/2
Z/2

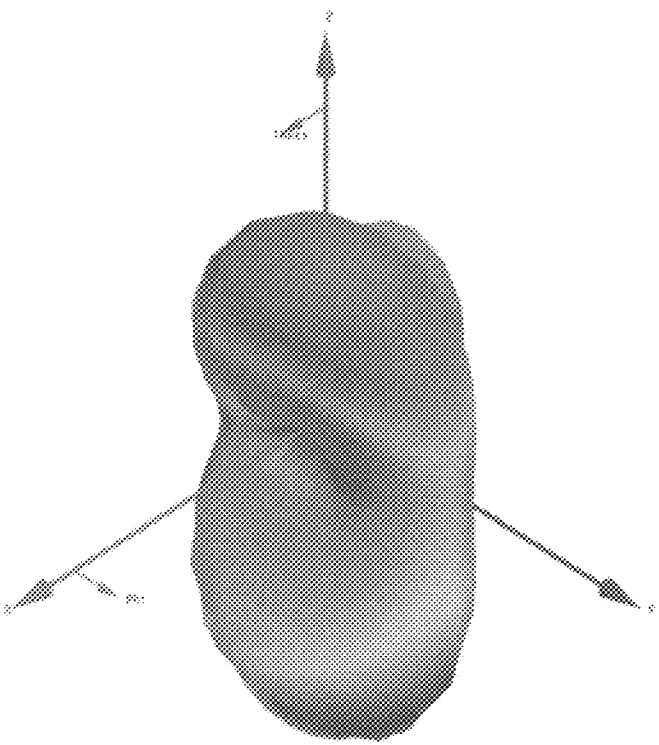
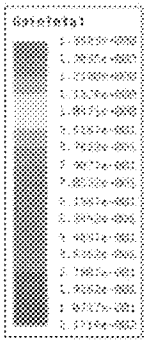
FIG. 20C

SINGLE-FEED MULTI-CELL METAMATERIAL ANTENNA DEVICES

PRIORITY CLAIMS AND RELATED APPLICATIONS

This patent document claims the benefits of the following U.S. Provisional Patent Applications:

1. Ser. No. 61/042,699 entitled "Dual Cell Metamaterial (MTM) Antenna Systems" and filed on Apr. 4, 2008; and
2. Ser. No. 61/053,616 entitled "Single-Feed Dual Cell Metamaterial Quadband and Pentaband Antenna Devices" and filed on May 15, 2008.

The disclosures of the above applications are incorporated by reference as part of the disclosure of this document.

BACKGROUND

The propagation of electromagnetic waves in most materials obeys the right handed rule for the (E,H,β) vector fields, where E is the electrical field, H is the magnetic field, and β is the wave vector. The phase velocity direction is the same as the direction of the signal energy propagation (group velocity) and the refractive index is a positive number. Such materials are "right handed" (RH). Most natural materials are RH materials. Artificial materials can also be RH materials.

A metamaterial (MTM) has an artificial structure. When designed with a structural average unit cell size p much smaller than the wavelength of the electromagnetic energy guided by the metamaterial, the metamaterial can behave like a homogeneous medium to the guided electromagnetic energy. Unlike RH materials, a metamaterial can exhibit a negative refractive index with permittivity ∈ and permeability μ being simultaneously negative, and the phase velocity direction is opposite to the direction of the signal energy propagation where the relative directions of the (E,H,β) vector fields follow the left handed rule. Metamaterials that support only a negative index of refraction with permittivity ∈ and permeability μ being simultaneously negative are pure "left handed" (LH) metamaterials.

Many metamaterials are mixtures of LH metamaterials and RH materials and thus are Composite Left and Right Handed (CRLH) metamaterials. A CRLH metamaterial can behave like a LH metamaterial at low frequencies and a RH material at high frequencies. Designs and properties of various CRLH metamaterials are described in, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

This document provides implementations of Composite Right-Left Handed (CRLH) metamaterial (MTM) antennas. In one aspect, a CRLH MTM antenna includes a substrate, MTM cells formed on the substrate, and a conductive launch stub formed on the substrate to be adjacent to each of the MTM cells and electromagnetically coupled to each of the MTM cells.

In another aspect, a CRLH MTM antenna device includes a dielectric substrate having a first surface on a first side and a second surface on a second side opposing the first side; a first cell conductive patch formed on the first surface; a second cell conductive patch formed on the first surface and adjacent to the first cell conductive patch by an insulation gap; and a shared conductive launch stub formed on the first surface adjacent to both the first and second cell conductive patches and separated from each of the first and second cell conductive patches by an insulation gap to be electromagnetically coupled to each of the first and second cell conductive patches. The shared conductive launch stub includes an extended strip line that directs a signal to the first and second cell conductive patches and receives signals from the first and second cell conductive patches. This device includes a cell ground conductive electrode formed on the second surface and located outside footprints projected by the first and second cell conductive patches onto the second surface; a first cell conductive via patch formed on the second surface and in a footprint projected by the first cell conductive patch onto the second surface; a first cell conductive via connector formed in the substrate to connect the first cell conductive patch to the first cell conductive via patch; a second cell conductive via patch formed on the second surface and in a footprint projected by the second cell conductive patch onto the second surface; a second cell conductive via connector formed in the substrate to connect the second cell conductive patch to the second cell conductive via patch; a first conductive strip line formed on the second surface to connect the first cell conductive via patch to the cell ground conductive electrode; and a second conductive strip line formed on the second surface to connect the second cell conductive via patch to the cell ground conductive electrode.

In another aspect, a CRLH MTM antenna device includes a dielectric substrate having a first surface on a first side and a second surface on a second side opposing the first side; a first cell conductive patch formed on the first surface; a second cell conductive patch formed on the first surface and separated from the first cell conductive patch; and a conductive launch stub formed on the first surface adjacent to both the first and second cell conductive patches and separated from each of the first and second cell conductive patches by an insulation gap to be electromagnetically coupled to each of the first and second cell conductive patches. The conductive launch stub includes a first conductive line to receive a signal from an external launch cable; a second conductive line extending from a first end of the conductive launch stub and guiding the signal to the first and second cell conductive patches; a meandering conductive line extending from the second end of the conductive launch stub to a location away from the first and second conductive patches; a cell ground conductive electrode formed on the second surface and located outside footprints projected by the first and second cell conductive patches, and the conductive launch stub onto the second surface; a first cell conductive via patch formed on the second surface and in a footprint projected by the first cell conductive patch onto the second surface; a first cell conductive via connector formed in the substrate to connect the first cell conductive patch to the first cell conductive via patch; a second cell conductive via patch formed on the second surface and in a footprint projected by the second cell conductive patch onto the second surface; a second cell conductive via connector formed in the substrate to connect the second cell conductive patch to the second cell conductive via patch; a third conductive via patch formed on the second surface and in substantially a footprint projected by the meandering strip line onto the second surface; a third conductive via connector formed in the substrate to connect the end of the meandering strip line to the third conductive via patch; a first conductive strip line formed on the second surface to connect the first cell conductive via patch to the cell ground conductive electrode; and a second conductive strip line formed on the second surface to connect the second cell conductive via patch to the cell ground conductive electrode.

These and other implementations and their variations are described in detail in the attached drawings, the detailed description and the claims.

BRIEF DESCRIPTION OF THE DRAWINGS

FIG. 8 illustrates an example of a 1D CRLH MTM TL with a truncated ground based on four unit cells;

FIG. 9 illustrates an equivalent circuit of the 1D CRLH MTM TL with the truncated ground shown in FIG. 8;

FIGS. 20A-20C illustrate a simulated radiation pattern at 900 MHz, 1.575 GHz, and 2.5 GHz, respectively, of the single feed multi-cell metamaterial antenna structure of FIGS. 14A-14D;

Figure 1:
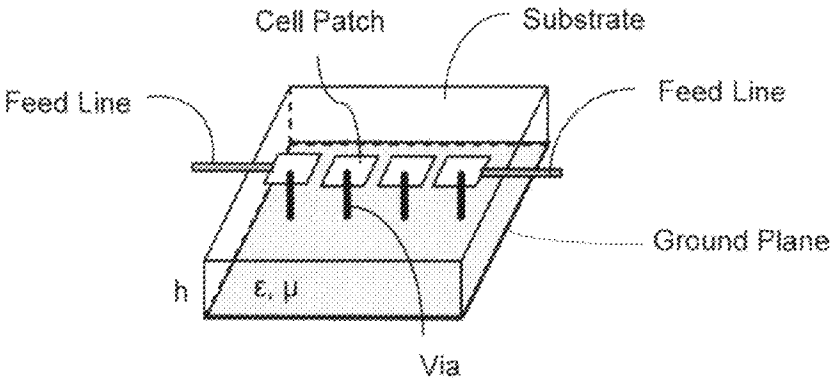
FIG. 1 illustrates an example of a 1D CRLH MTM TL based on four unit cells.

In the appended figures, similar components and/or features may have the same reference numeral. Further, various components of the same type may be distinguished by following the reference numeral by a dash and a second label that distinguishes among the similar components. If only the first reference numeral is used in the specification, the description is applicable to any one of the similar components having the same first reference numeral irrespective of the second reference numeral.

DETAILED DESCRIPTION

Metamaterial (MTM) structures can be used to construct antennas and other electrical components and devices, allowing for a wide range of technology advancements such as size reduction and performance improvements. The MTM antenna structures can be fabricated on various circuit platforms, for example, a conventional FR-4 Printed Circuit Board (PCB) or a Flexible Printed Circuit (FPC) board. Examples of other fabrication techniques include thin film fabrication technique, system on chip (SOC) technique, low temperature co-fired ceramic (LTCC) technique, and monolithic microwave integrated circuit (MMIC) technique. Exemplary MTM antenna structures are described in U.S. patent application Ser. No. 11/741,674 entitled "Antennas, Devices, and Systems Based on Metamaterial Structures" and filed on Apr. 27, 2007 (U.S. Publication No. US-2008-0258981-A1) and U.S. patent application Ser. No. 11/844,982 entitled "Antennas Based on Metamaterial Structures" and filed on Aug. 24, 2007 (U.S. Publication No. US-2008-0048917-A1). The disclosures of these two patent applications are incorporated by reference as part of the disclosure of this document.

An MTM antenna or MTM transmission line (TL) is a MTM structure with one or more MTM unit cells. The equivalent circuit for each MTM unit cell includes a right-handed series inductance (LR), a right-handed shunt capacitance (CR), a left-handed series capacitance (CL), and a left-handed shunt inductance (LL). LL and CL are structured and connected to provide the left-handed properties to the unit cell. This type of CRLH TLs or antennas can be implemented by using distributed circuit elements, lumped circuit elements or a combination of both. Each unit cell is smaller than ~$\lambda/4$ where $\lambda$ is the wavelength of the electromagnetic signal that is transmitted in the CRLH TL or antenna.

A pure LH metamaterial follows the left-hand rule for the vector trio (E,H,$\beta$), and the phase velocity direction is opposite to the signal energy propagation. Both the permittivity $\in$ and permeability $\mu$ of the LH material are negative. A CRLH metamaterial can exhibit both left-hand and right-hand electromagnetic modes of propagation depending on the regime or frequency of operation. Under certain circumstances, a CRLH metamaterial can exhibit a non-zero group velocity when the wavevector of a signal is zero. This situation occurs when both left-hand and right-hand modes are balanced. In an unbalanced mode, there is a bandgap in which electromagnetic wave propagation is forbidden. In the balanced case, the dispersion curve does not show any discontinuity at the transition point of the propagation constant $\beta(\omega_o)=0$ between the left- and right-hand modes, where the guided wavelength is infinite, i.e., $\lambda_g=2\pi/|\beta|\rightarrow\infty$, while the group velocity is positive:

$$v_g = \left.\frac{d\omega}{d\beta}\right|_{\beta=0} > 0.$$

This state corresponds to the zeroth order mode m=0 in a TL implementation in the LH region. The CRHL structure supports a fine spectrum of low frequencies with the dispersion relation that follows the negative $\beta$ parabolic region. This allows a physically small device to be built that is electromagnetically large with unique capabilities in manipulating and controlling near-field radiation patterns. When this TL is used as a Zeroth Order Resonator (ZOR), it allows a constant amplitude and phase resonance across the entire resonator. The ZOR mode can be used to build MTM-based power combiners and splitters or dividers, directional couplers, matching networks, and leaky wave antennas.

In the case of RH TL resonators, the resonance frequency corresponds to electrical lengths $\theta_m=\beta_m l=m\pi$ (m=1, 2, 3 . . . ), where l is the length of the TL. The TL length should be long to reach low and wider spectrum of resonant frequencies. The operating frequencies of a pure LH material are at low frequencies. A CRLH MTM structure is very different from an RH or LH material and can be used to reach both high and low spectral regions of the RF spectral ranges. In the CRLH case $\theta_m=\beta_m l=m\pi$, where l is the length of the CRLH TL and the parameter m=0, ±1, ±2, ±3 . . . ±∞.

FIG. 1 illustrates an example of a 1D CRLH MTM TL based on four unit cells. One unit cell includes a cell patch and a via, and is a minimum unit that repeats itself to build the MTM structure. The four cell patches are placed on a substrate with respective centered vias connected to the ground plane.

Figure 2:
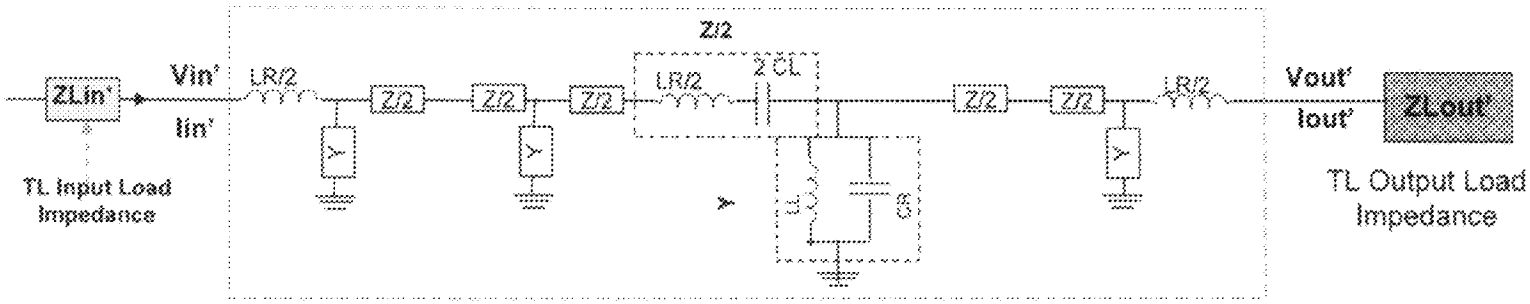
FIG. 2 illustrates an equivalent circuit of the 1D CRLH MTM TL shown in FIG. 1.

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. LR is due to the cell patch on the dielectric substrate, and CR is due to the dielectric substrate being sandwiched between the cell patch and the ground plane. CL is due to the presence of two adjacent cell patches, and the via induces LL.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of LL and CR. The relationships among these parameters are expressed as follows:

$$\omega_{SH} = \frac{1}{\sqrt{LLCR}}; \quad \omega_{SE}\frac{1}{\sqrt{LRCL}}; \quad \omega_R = \frac{1}{\sqrt{LRCR}}; \quad \omega_L = \frac{1}{\sqrt{LLCL}} \qquad \text{Eq. (1)}$$

where, $$Z = j\omega LR + \frac{1}{j\omega CL}$$

and $$Y = j\omega CR + \frac{1}{j\omega LL}$$

The two unit cells at the input/output edges in FIG. 1 do not include CL, since CL represents the capacitance between two adjacent cell patches and is missing at these input/output edges. The absence of the CL portion at the edge unit cells prevents $\omega_{SE}$ frequency from resonating. Therefore, only $\omega_{SH}$ appears as an m=0 resonance frequency.

Figure 3:
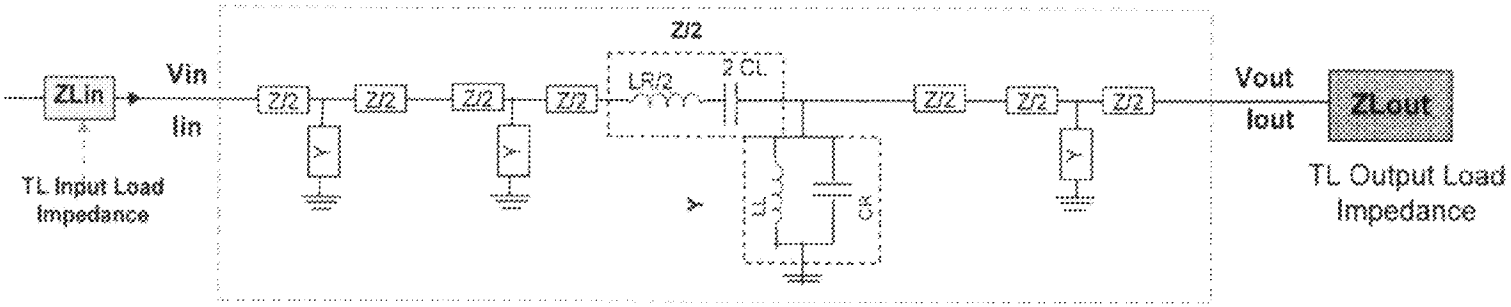
FIG. 3 illustrates another representation of the equivalent circuit of the 1D CRLH MTM TL shown in FIG. 1.

To simplify the computational analysis, a portion of the ZLin' and ZLout' series capacitor is included to compensate for the missing CL portion, and the remaining input and output load impedances are denoted as ZLin and ZLout, respectively, as seen in FIG. 3. Under this condition, all unit cells have identical parameters as represented by two series Z/2 blocks and one shunt Y block in FIG. 3, where the Z/2 block includes a series combination of LR/2 and 2CL, and the Y block includes a parallel combination of LL and CR.

Figure 4A:
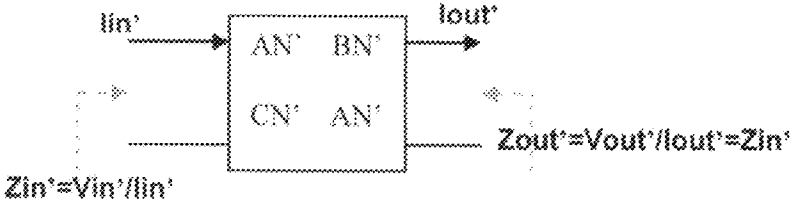
FIG. 4A illustrates a two-port network matrix representation for the 1D CRLH TL equivalent circuit shown in FIG. 2.
Figure 4B:
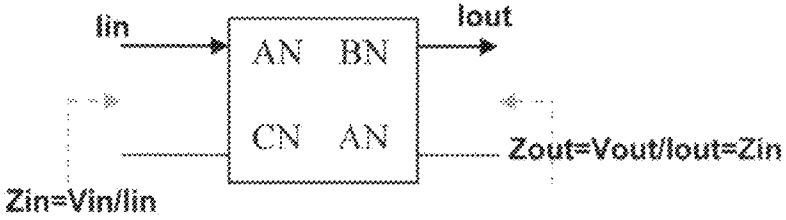
FIG. 4B illustrates another two-port network matrix representation for the 1D CRLH TL equivalent circuit shown in FIG. 3.
Figure 5:
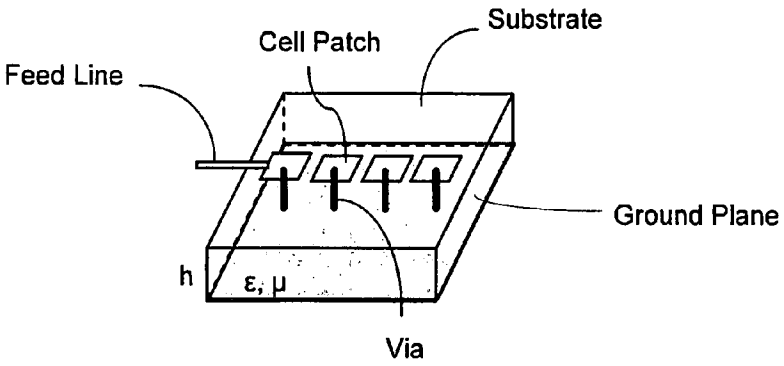
FIG. 5 illustrates an example of a 1D CRLH MTM antenna based on four unit cells.
Figure 6B:
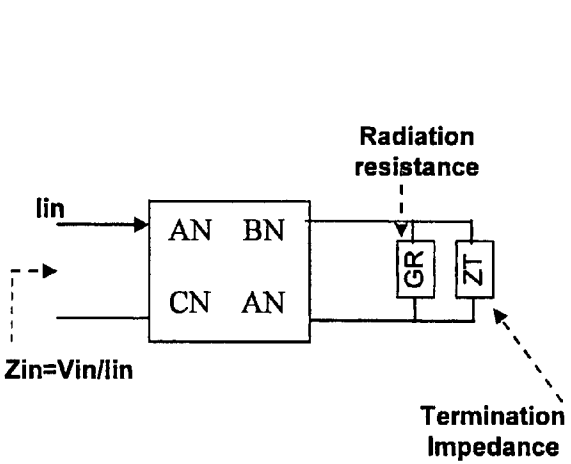
FIG. 6B illustrates another two-port network matrix representation for the 1D CRLH antenna equivalent circuit analogous to the TL case shown in FIG. 4B.
Figure 6A:
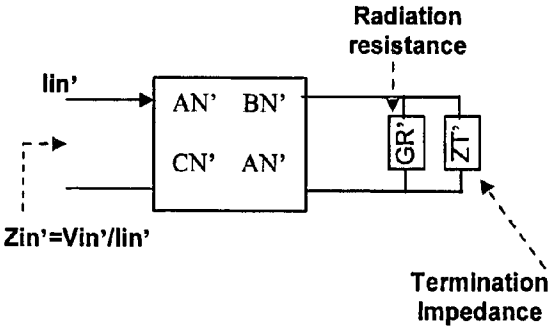
FIG. 6A illustrates a two-port network matrix representation for the 1D CRLH antenna equivalent circuit analogous to the TL case shown in FIG. 4A.

FIG. 4A and FIG. 4B illustrate a two-port network matrix representation for TL circuits without the load impedances as shown in FIG. 2 and FIG. 3, respectively, FIG. 5 illustrates an example of a 1D CRLH MTM antenna based on four unit cells. FIG. 6A shows a two-port network matrix representation for the antenna circuit in FIG. 5. FIG. 6B shows a two-port network matrix representation for the antenna circuit in FIG. 5 with the modification at the edges to account for the missing CL portion to have all the unit cells identical. FIGS. 6A and 6B are analogous to the TL circuits shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix}\begin{pmatrix} Vout \\ Iout \end{pmatrix} \qquad \text{Eq. (2)}$$

where AN=DN because the CRLH MTM TL circuit in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional 2CL as expressed below:

$$ZLin' = ZLin + \frac{2}{j\omega CL}, \quad ZLout' = ZLout + \frac{2}{j\omega CL}, \quad ZT' = ZT + \frac{2}{j\omega CL} \qquad \text{Eq. (3)}$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (1) are valid for the circuit in FIG. 2 with the modified values AN', BN', and CN', which reflect the missing CL portion at the two edges.

The frequency bands can be determined from the dispersion equation derived by letting the N CRLH cell structure resonate with $n\pi$ propagation phase length, where n=0, ±1, ±2, . . . ±N. Here, each of the N CRLH cells is represented by Z and Y in Eq. (1), which is different from the structure shown in FIG. 2, where CL is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N), \ \Rightarrow |A_N| \le 1 \Rightarrow 0 \le \chi = -ZY \le 4\forall N \\ \text{where} \\ A_N = 1 \text{ at even resonances } |n| = 2m \in \left\{0, 2, 4, \ldots 2\times \mathrm{Int}\left(\frac{N-1}{2}\right)\right\} \\ \text{and} \\ A_N = -1 \text{ at odd resonances } |n| = 2m+1 \in \left\{1, 3, \ldots \left(2\times \mathrm{Int}\left(\frac{N}{2}\right)-1\right)\right\}, \end{cases} \qquad \text{Eq. (4)}$$

where Z and Y are given in Eq. (1), AN is derived from the linear cascade of N identical CRLH unit cells as in FIG. 3, and p is the cell size. Odd n=(2 m+1) and even n=2 m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of CL at the end cells, regardless of the number of cells. Higher-order frequencies are given by the following equations for the different values of $\chi$ specified in Table 1:

$$\text{For } n > 0,\ \omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 + \chi\omega_R^2}{2}\right)^2 - \omega_{SH}^2\omega_{SE}^2} \qquad \text{Eq. (5)}$$

Table 1 provides $\chi$ values for N=1, 2, 3, and 4. It should be noted that the higher-order resonances |n|>0 are the same regardless if the full CL is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as stated in Eq. (4).

TABLE 1

Resonances for N = 1, 2, 3 and 4 cells

| | Modes | | | |
|---|---|---|---|---|
| N | \|n\| = 0 | \|n\| = 1 | \|n\| = 2 | \|n\| = 3 |
| N = 1 | $\chi_{(1,0)} = 0$; $\omega_0 = \omega_{SH}$ | | | |
| N = 2 | $\chi_{(2,0)} = 0$; $\omega_0 = \omega_{SH}$ | $\chi_{(2,1)} = 2$ | | |
| N = 3 | $\chi_{(3,0)} = 0$; $\omega_0 = \omega_{SH}$ | $\chi_{(3,1)} = 1$ | $\chi_{(3,2)} = 3$ | |
| N = 4 | $\chi_{(4,0)} = 0$; $\omega_0 = \omega_{SH}$ | $\chi_{(4,1)} = 2 - \sqrt{2}$ | $\chi_{(4,2)} = 2$ | |

Figure 7B:
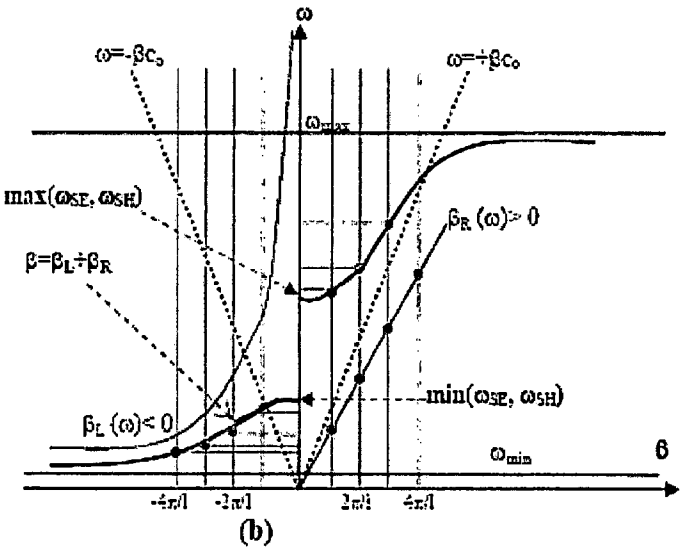
FIG. 7B illustrates an example of a dispersion curve for the unbalanced case.
Figure 7A:
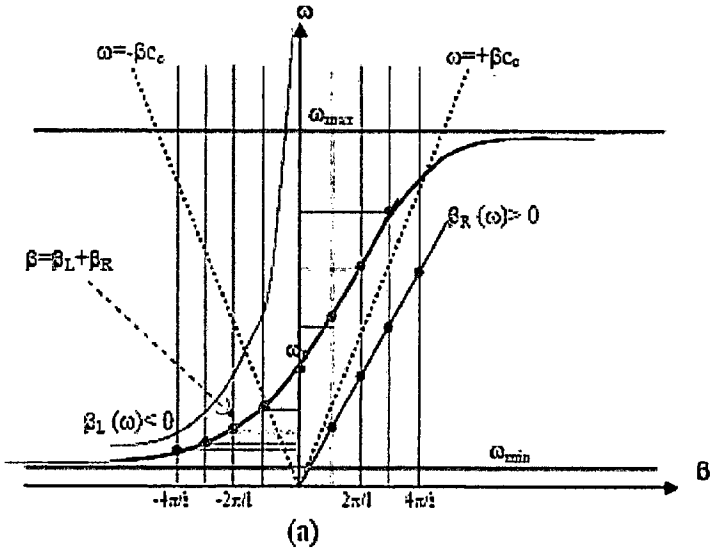
FIG. 7A illustrates an example of a dispersion curve for the balanced case.

The dispersion curve $\beta$ as a function of frequency $\omega$ is illustrated in FIGS. 7A and 7B for the $\omega_{SE}=\omega_{SH}$ (balanced, i.e., LR CL=LL CR) and $\omega_{SE}\neq\omega_{SH}$ (unbalanced) cases, respectively. In the latter case, there is a frequency gap between $\min(\omega_{SE},\omega_{SH})$ and $\max(\omega_{SE},\omega_{SH})$. The limiting frequencies $\omega_{min}$ and $\omega_{max}$ values are given by the same resonance equations in Eq. (5) with $\chi$ reaching its upper bound $\chi$=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \qquad \text{Eq. (6)}$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}$$

In addition, FIGS. 7A and 7B provide examples of the resonance position along the dispersion curves. In the RH region (n>0) the structure size l=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper. Thus, the first condition to obtain broadbands, $1^{st}$ BB condition, can be expressed as follows:

COND1: $1^{st}$ BB condition $$\left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \omega_{\pm 1}, \omega_{\pm 2}\ldots \qquad \text{Eq. (7)}$$

$$\Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with } p = \text{cell size and } \left.\frac{d\chi}{d\omega}\right|_{res} = \frac{2\omega_{\pm n}}{\omega_R^2}\left(1 - \frac{\omega_{SE}^2\omega_{SH}^2}{\omega_{\pm n}^4}\right)$$

where $\chi$ is given in Eq. (4) and $\omega_R$ is defined in Eq. (1). The dispersion relation in Eq. (4) indicates that resonances occur when |AN|=1, which leads to a zero denominator in the $1^{st}$ BB condition (COND1) of Eq. (7). As a reminder, AN is the first transmission matrix entry of the N identical unit cells (FIG. 4B and FIG. 6B). The calculation shows that COND1 is indeed independent of N and given by the second equation in Eq. (7). It is the values of the numerator and $\chi$ at resonances, which are shown in Table 1, that define the slopes of the dispersion curves, and hence possible bandwidths. Targeted structures are at most Np=λ/40 in size with the bandwidth exceeding 4%. For structures with small cell sizes p, Eq. (7) indicates that high $\omega_R$ values satisfy COND1, i.e., low CR and LR values, since for n<0 resonances occur at $\chi$ values near 4 in Table 1, in other terms ($1-\chi/4\rightarrow 0$).

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL circuit in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1 - \frac{\chi}{4}\right), \qquad \text{Eq. (8)}$$

which has only positive real values. One reason that B1/C1 is greater than zero is due to the condition of |AN|≤1 in Eq. (4), which leads to the following impedance condition:

$$0 \le -ZY = \chi \le 4.$$

The $2^{nd}$ broadband (BB) condition is for Zin to slightly vary with frequency near resonances in order to maintain constant matching. Remember that the real input impedance Zin' includes a contribution from the CL series capacitance as stated in Eq. (3). The $2^{nd}$ BB condition is given below:

COND2: $2^{ed}$ BB condition: near resonances, $$\left.\frac{dZin}{d\omega}\right|_{near\ res} << 1 \qquad \text{Eq. (9)}$$

Different from the transmission line example in FIG. 2 and FIG. 3, antenna designs have an open-ended side with an infinite impedance which poorly matches the structure edge impedance. The capacitance termination is given by the equation below:

$$Z_T = \frac{AN}{CN}, \qquad \text{Eq. (10)}$$

which depends on N and is purely imaginary. Since LH resonances are typically narrower than RH resonances, selected matching values are closer to the ones derived in the n<0 region than the n>0 region.

To increase the bandwidth of LH resonances, the shunt capacitor CR should be reduced. This reduction can lead to higher $\omega_R$ values of steeper dispersion curves as explained in Eq. (7). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground electrode outside the footprint of the cell patch. This truncated ground approach may be implemented in various configurations to achieve broadband resonances.

Figure 10:
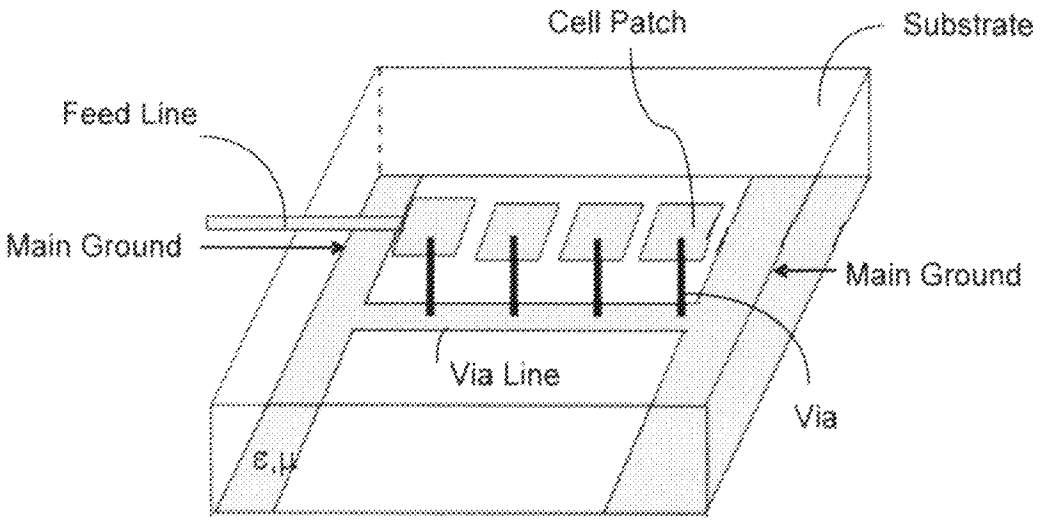
FIG. 10 illustrates an example of a 1D CRLH MTM antenna with a truncated ground based on four unit cells.

FIG. 8 illustrates one example of a truncated ground electrode for a four-cell transmission line where the ground has a dimension that is less than the cell patch along one direction underneath the cell patch. The ground conductive layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

Figure 11:
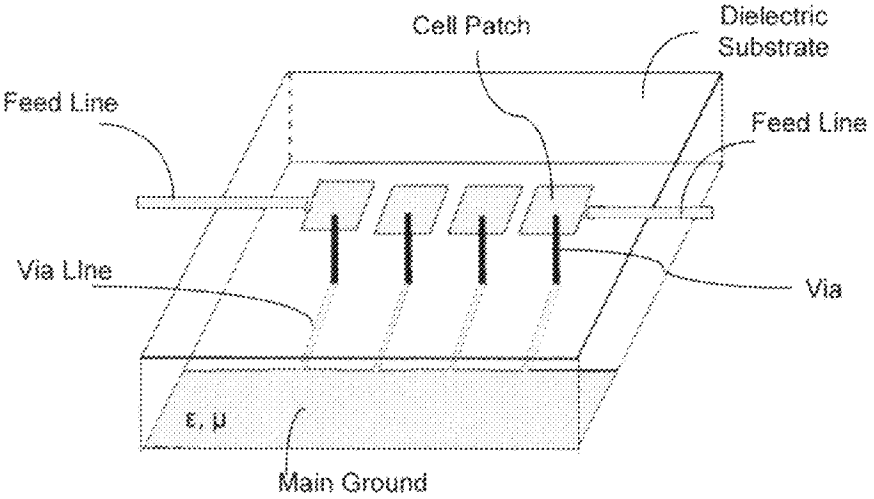
FIG. 11 illustrates another example of a 1D CRLH MTM TL with a truncated ground based on four unit cells.

FIG. 11 illustrates another example of a truncated ground structure. In this example, the ground conductive layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, CR becomes very small, and the resonances follow the same equations as in Eqs. (1), (5) and (6) and Table 1 as explained below:

Approach 1 (FIGS. 8 and 9)

Resonances are represented by Eqs. (1), (5) and (6) and Table 1 after replacing LR by (LR+Lp).

Furthermore, for |n|≠0, each mode has two resonances corresponding to (1) ω±n for LR being replaced by LR+Lp; and (2) ω±n for LR being replaced by LR+Lp/N where N is the number of cells. The corresponding impedance equation is:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \qquad \text{Eq. (11)}$$

where $$\chi = -YZ \text{ and } \chi = -YZ_P,$$

where Zp=jωLp and Z, Y are defined in Eq. (2). The above impedance equation Eq. (11) shows that the two resonances ω and ω' have low and high impedances, respectively. Thus, it is easy to tune near the ω resonance in most cases.

Figure 12:
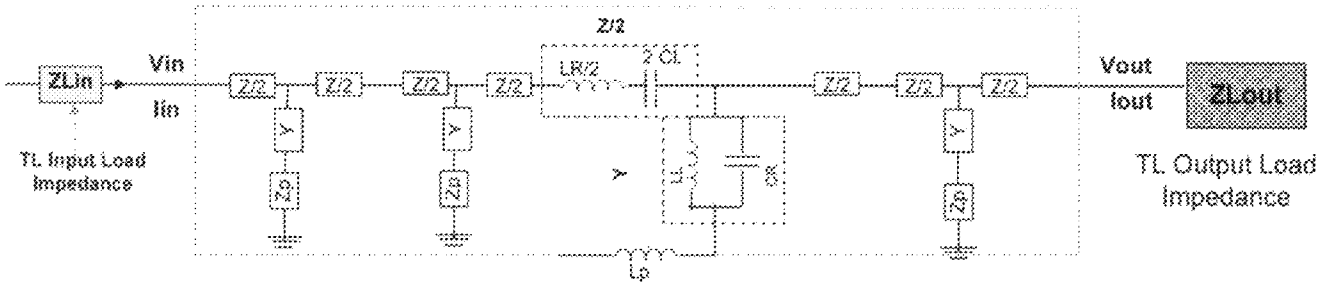
FIG. 12 illustrates an equivalent circuit of the 1D CRLH MTM TL with the truncated ground shown in FIG. 11.

Approach 2 (FIGS. 11 and 12)

Resonances are represented by Eqs. (1), (5), and (6) and Table 1 after replacing LL by (LL+Lp). In the second approach, the combined shunt inductor (LL+Lp) increases while the shunt capacitor CR decreases, which leads to lower LH frequencies.

Figure 13:
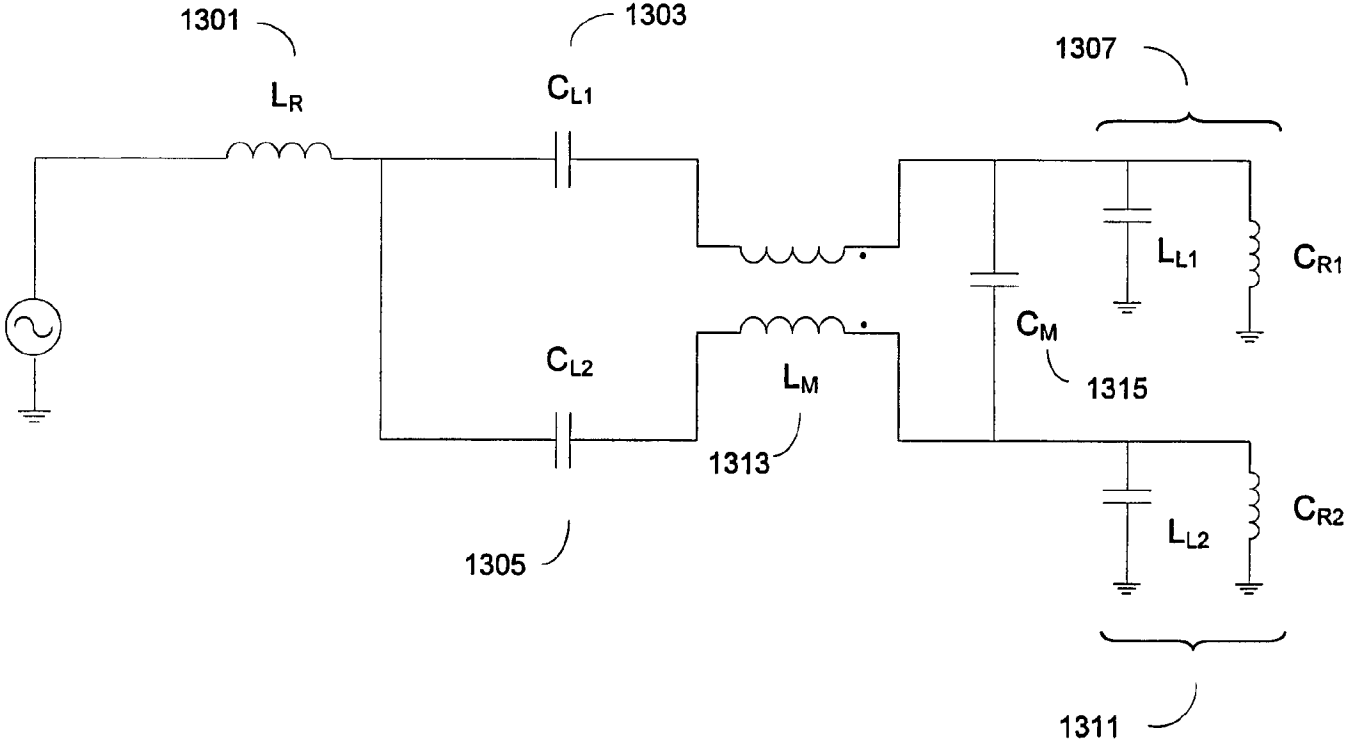
FIG. 13 illustrates an equivalent circuit of a CRLH MTM Single Feed Multi-Cell (SFMC) antenna structure.

FIG. 13 illustrates an exemplary equivalent circuit of a CRLH MTM Single Feed Multi-Cell (SFMC) antenna structure. In FIG. 13, a first MTM cell 1307 represented by ($C_{R1}$, $L_{L1}$) and a second MTM cell 1311 represented by ($C_{R2}$, $L_{L2}$) are connected in parallel with each other and share one feed line $L_R$ 1301. In this circuit design, different capacitive loadings, $C_{L1}$ 1303 and $C_{L2}$ 1305, may be provided to reduce destructive interactions between the parallel MTM cells depending on the capacitive couplings $C_{L1}$ 1303 and $C_{L2}$ 1305. Apart from the mutual coupling, as indicated by $L_M$ 1313 and $C_M$ 1315 of the two MTM cells, the equivalent circuit of this SFMC model can be simplified to a parallel combination of two separate unit MTM cell structures comprising ($C_{L1}$, $L_R$, $C_{R1}$, $L_{L1}$) and ($C_{L2}$, $L_R$, $C_{R2}$, $L_{L2}$). $L_M$ 1313 may be controlled by the distance between two via traces, while $C_M$ 1315 may be controlled by the distance between the two MTM cells (1307 and 1311). As a result, the interaction and coupling between the two MTM cells described herein may contribute to GPS band, DCS, as well as PCS Band efficiency.

Embodiments of MTM based antenna structures presented herein and their advantages may be understood by referring to detailed exemplars and figures. In one implementation, a Composite Right-Left Handed (CRLH) Metamaterial (MTM) antenna structures may use two cascading MTM cell patches that share a single feed line. The number, type, and construction of the MTM cell patches and feed line described herein may be designed in a variety of ways. For example, the number of MTM cell patches may include more than two cascading cells, and the feed line may be designed to support multiple launch pads. In another implementation, the resonant frequencies and associated efficiencies can be controlled by electromagnetic coupling between each of the two MTM cells and a launch pad, as well as electromagnetic coupling between the two MTM cells. These MTM antenna structures can be implemented in antenna systems having a single port that support multiple frequency bands such as GPS and WWAN. Devices that may benefit from this MTM antenna design may include wireless laptops, GPS devices, or any other devices transmitting or receiving multiple RF signals. Reduced construction costs and footprint sizes are possible since these MTM antenna structures effectively combine two or more antennas to a single antenna.

These antenna structures can be implemented by using conventional FR-4 printed circuit boards. Examples of other fabrication techniques include, but are not limited to, thin film fabrication technique, system on chip (SOC) technique, low temperature co-fired ceramic (LTCC) technique, and monolithic microwave integrated circuit (MMIC) technique.

Figure 14A:
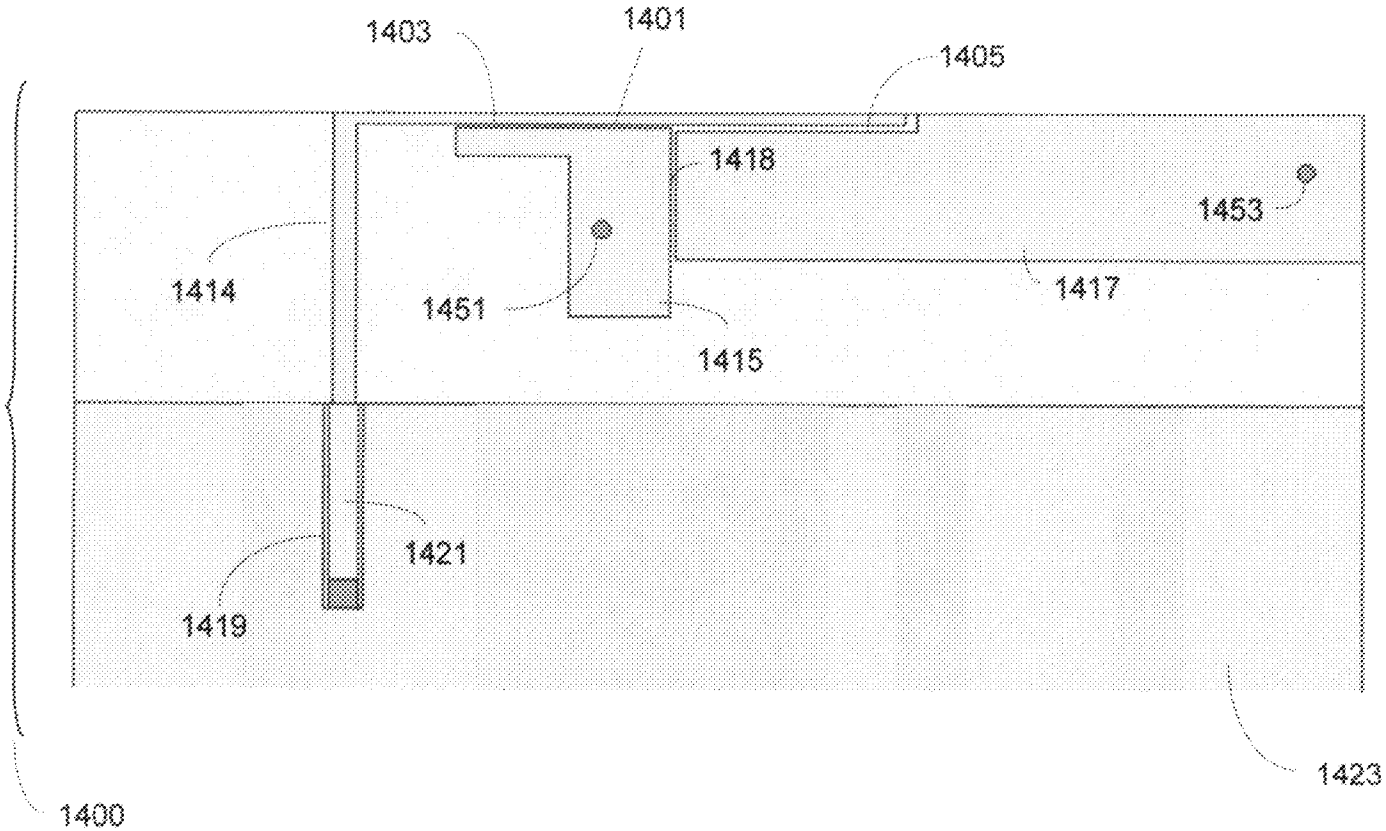
FIGS. 14A-14D illustrate the top view of the top layer, the top view of the bottom layer, the side view, and 3D perspective view, respectively, of an exemplary single feed multi-cell metamaterial antenna structure.

FIGS. 14A-14D show an example of a Single-Feed Multi-Cell (SFMC) MTM antenna design based on a Single-Feed Dual-Cell (SFDC) MTM antenna structure. This antenna includes two cells 1403 and 1405 formed in a substrate 1459 with two opposing surfaces 1400 and 1430. FIG. 14A is a top view of the top layer of the SFDC MTM antenna structure is illustrated and shows a first cell conductive patch 1415 of the first cell 1403 formed on the first surface 1400; a second cell conductive patch 1417 of the second cell 1405 formed on the first surface 1400 and adjacent to the first cell conductive patch 1415 by an insulation cell gap 1418; and a shared conductive launch stub 1401 formed on the first surface 1400 adjacent to both the first and second cell conductive patches 1415 and 1417 and separated from each of the first and second cell conductive patches 1415 and 1417 by a capacitive coupling gap for the first cell 1403 and a capacitive coupling gap for the second cell 1405, respectively, which are electromagnetically coupled to each of the first and second cell conductive patches 1415 and 1417. The shared conductive launch stub 1401 includes an extended strip line that directs and receives signals from the first and second cell conductive patches 1415 and 1417. A top ground conductive electrode 1423 is formed on the first surface 1400 and spaced away from the first and second cell conductive patches 1415 and 1417. In this example, the top ground conductive electrode 1423 is patterned to include a grounded co-planar waveguide (CPW) 1421 that has a first terminal and a second terminal in which the second terminal is connected to a feed line 1414. The shared conductive launch stub 1401 has an extended strip line that is connected to the feed line 1414 to conduct signals to or from the two cell conductive patches 1415 and 1417.

Figure 14B:
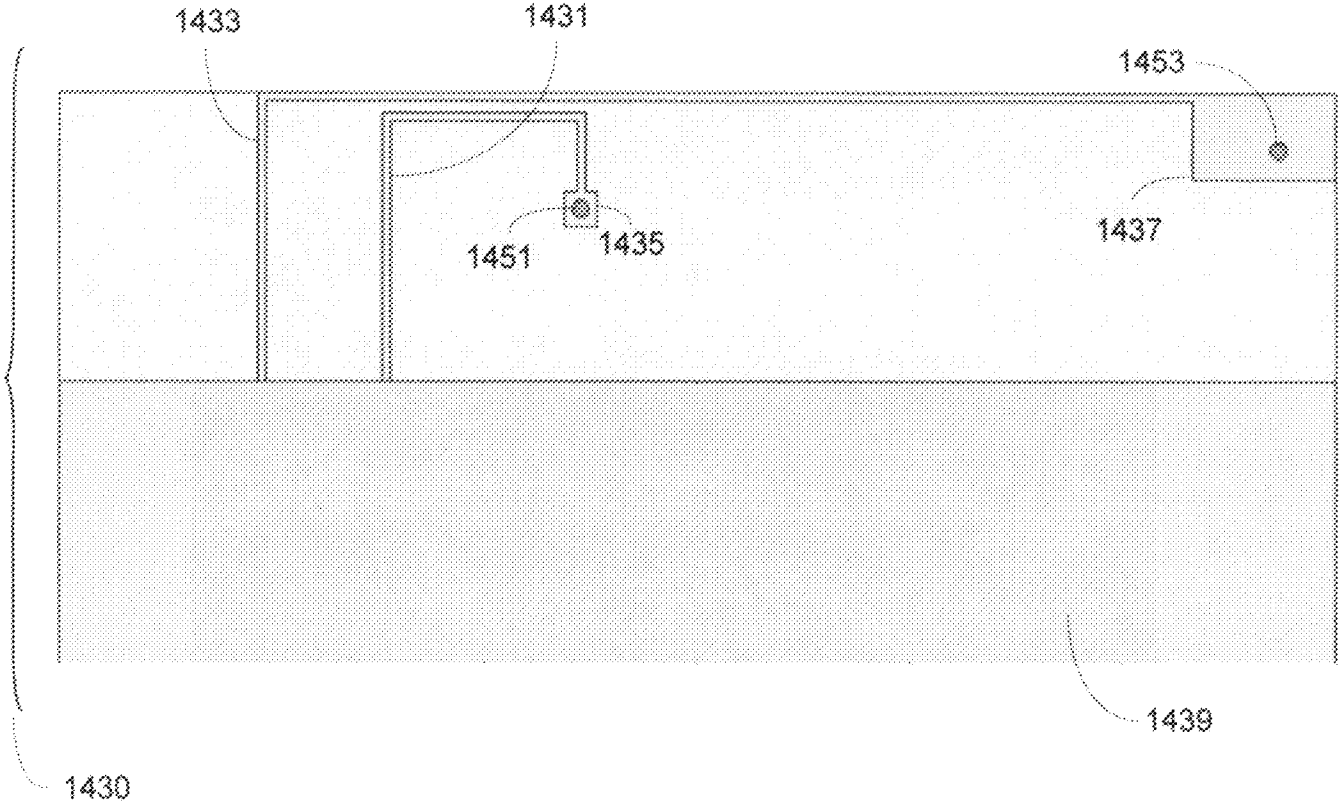
Figure 14C:
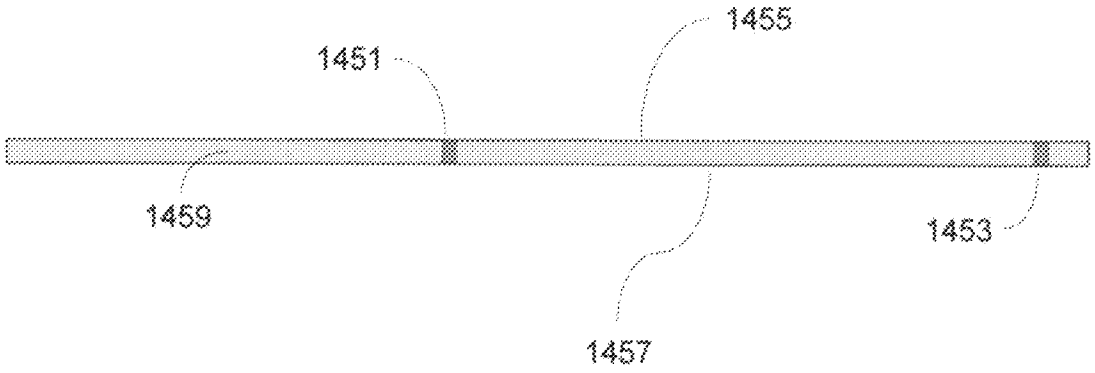

FIG. 14B and FIG. 14C show a top view of the bottom layer and a cross-sectional view of the SFDC MTM antenna structure, respectively. In FIG. 14B, a bottom ground conductive electrode 1439 is shown to be on the second surface 1430 and located outside the footprints projected by the first and second cell conductive patches 1415 and 1417 onto the second surface 1430. The first cell 1403 has a first cell conductive via patch 1435 formed on the second surface 1430 is in a footprint projected by the first cell conductive patch 1415 on the first surface 1400 onto the second surface 1430 and a first cell conductive via connector 1451 formed on the substrate 1459 to connect the first cell conductive patch 1415 on the first surface 1400 to the first cell conductive via patch 1435 on the second surface 1430. The second cell 1405 includes a second cell conductive via patch 1437 formed on the second surface 1430 in a footprint projected by the second cell conductive patch 1417 on the first surface 1400 onto the second surface 1430 and a second cell conductive via connector 1453 formed in the substrate 1459 to connect the second cell conductive patch 1417 on the first surface 1400 to the second cell conductive via patch 1437 on the second surface 1430.

A first conductive strip line 1431 is also formed on the second surface 1430 to connect the first cell conductive via patch 1435 to the bottom ground conductive electrode 1439 and a second conductive stripe line 1433 is formed on the second surface 1430 to connect the second cell conductive via patch 1437 to the bottom ground conductive electrode 1439.

Figure 14D:
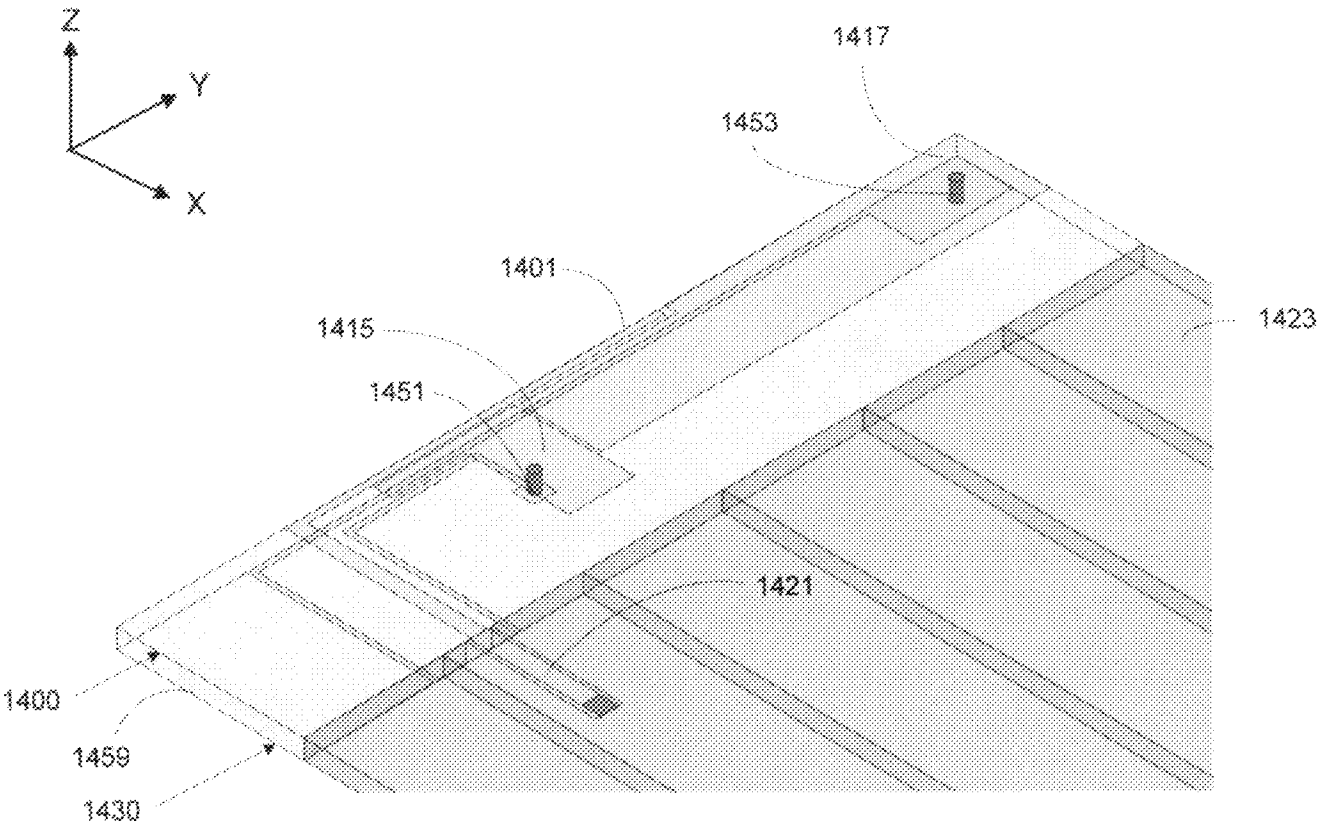

FIG. 14D illustrates a 3D perspective of the Single-Feed Dual-Cell (SFDC) MTM antenna structure of FIG. 14A-14C. In this figure, inter-layer relationships between the first and second surfaces 1400 and 1430 are illustrated to show the relative positioning of components located on the first surface 1400 relative to the components located on the second surface 1430. Elements illustrated in 3D view include the first conductive patch 1415, first cell conductive via connector 1451, shared conductive launch stub 1401, second cell conductive via connector 1453, second conductive patch 1417, grounded CPW 1421, and top ground electrode 1423.

Figure 15A:
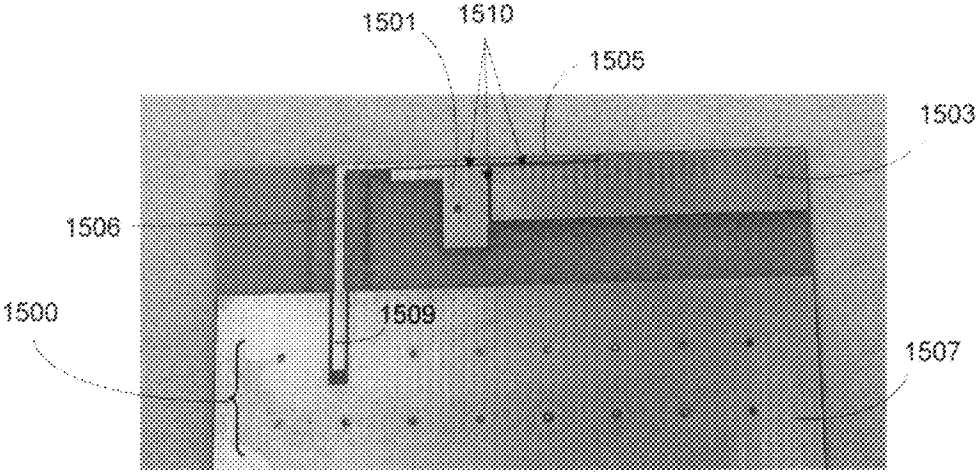
FIGS. 15A-15B illustrate photographs an actual fabricated sample of the top view of the top layer and bottom layer, respectively, of the single feed multi-cell metamaterial antenna structure illustrated in FIGS. 14A-14B.
Figure 15B:
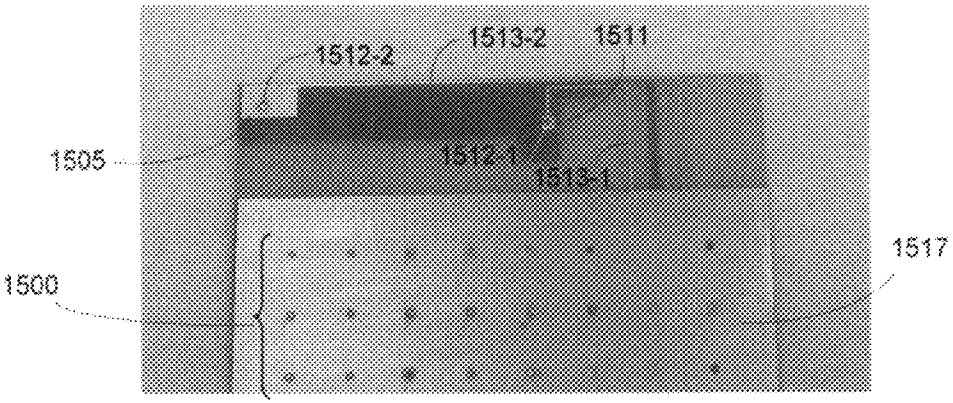

FIGS. 15A and 15B show images of a sample antenna fabricated using FR-4 substrates based on the above design. This sample antenna has a matrix of vias 1500 connecting the top ground electrode 1507 and the bottom ground electrode 1517. Such via array designs are modeled after the array of slabs shown in FIGS. 14A-14D and are used in this fabricated sample. As shown in FIG. 15A, an antenna structure is featured by a single launch stub 1505 feeding two cascading MTM cell patches 1501 and 1503 simultaneously. A grounded CPW line 1509 is connected to a feed line 1506 that is connected to the launch stub 1505. In another implementation, the antenna element can be fed by using a co-planar waveguide (CPW) line without a bottom GND. In yet another implementation, the antenna element can be fed with a probed patch, a cable connector or other forms of RF feed lines.

The grounded CPW line may be used to deliver power to the antenna element through the feed line and the launch stub. In particular, the feed line can serve as an impedance matching device, delivering power from the CPW line to the launch stub. Gaps 1510 may separate the launch stub and each of the MTM cells (1501, 1503) to electromagnetically couple these elements. The dimension of each gap, which may range between 4-12 mils, for example, may be different and can contribute to the performance of the antenna. Each MTM cell may be connected separately to the bottom GND 1517 through a via (1512-1, 1512-2) and a via trace (1513-1, 1513-2).

Figure 16:
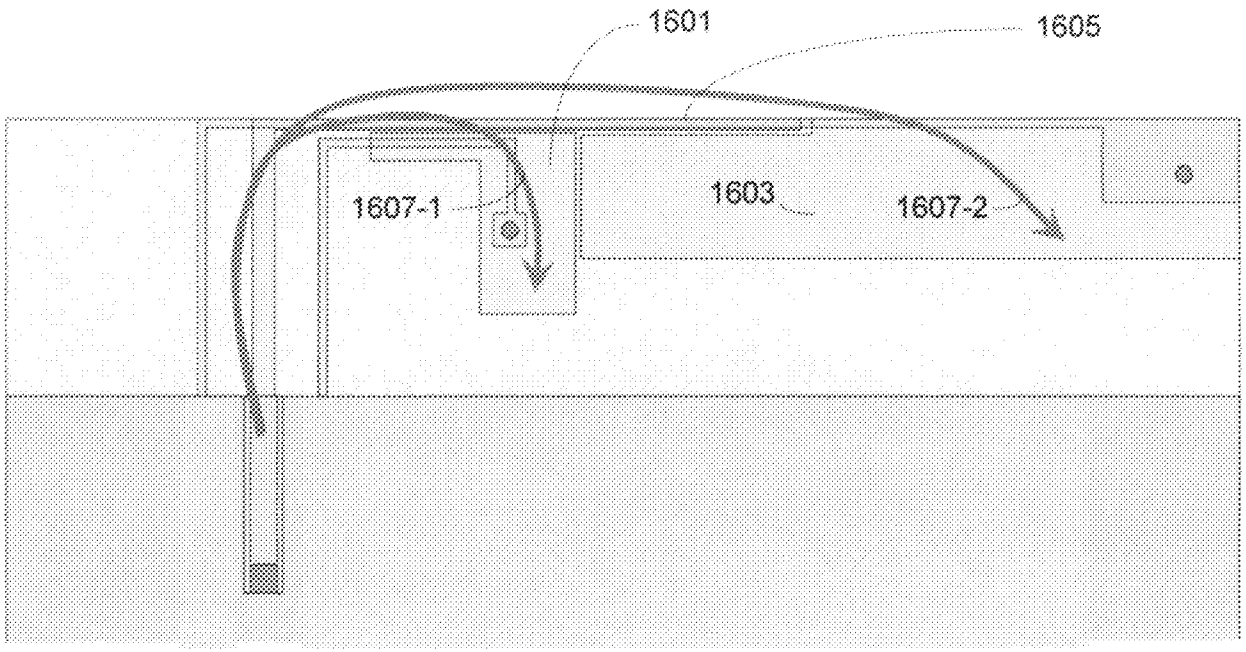
FIG. 16 illustrates the flow of directions of electromagnetic coupling in the single feed multi-cell metamaterial antenna structure.

The two cascading MTM cells described herein, and further illustrated in FIG. 16, may be fed in such a way that the electromagnetic coupling between the MTM cell#1 1601 and the launch stub 1605 and that between the MTM cell#2 1603 and the launch stub 1605 are in the same direction. Flows (1607-1, 1607-2) of electromagnetic energy in this case are schematically shown in FIG. 16. In this figure, both the top and bottom layers are superimposed together. This design allows for mutual enhancement of the coupling effect, thereby generating efficient radiating modes. These radiating modes may originate from electromagnetic radiation of the individual MTM cells as well as the interaction between the two MTM cells.

The components, description and location of the SFDC MTM antenna design described herein are summarized in the Table 1.

TABLE 1

Element parts for SFDC MTM antenna design

| Parameter | Description | | Location |
|---|---|---|---|
| Antenna Element | Comprises two MTM Cells connected to a GND 50 Ω CPW line via a Launch stub and a Feed Line. Both the Feed Line and Launch Stub can be located on the top layer of the FR-4 substrate. | | Top Layer |
| Feed Line | Connects the Launch Stub with the GND 50 Ω CPW line. | | Top Layer |
| Launch Stub | Are typically rectangular in shape and delivers electromagnetic energy to each of the two MTM cells by coupling over a slim gap. | | Top Layer |
| MTM Cells | Cell Patch | One is substantially L shaped; the other is substantially rectangular shaped. | Top Layer |
| | Via | Are generally cylindrical in shape. Connects each of the cell patches with a corresponding Via Pad. | |
| | Via Pad | Connects the bottom part of the Via to a corresponding Via Trace | Bottom Layer |
| | Via Trace | A thin trace that connects the Via Pad, hence the corresponding MTM cell, to the bottom GND. | Bottom Layer |

Structural changes to each cell and various other components can affect the resonance and matching of multiple modes. In particular, the antenna resonances can be affected by the presence of the left handed mode. In general, the left handed mode helps excite and better match the lowest resonance as well as improves the matching of higher resonances.

The design shown in FIGS. 14A-14D may be implemented in various configurations. For example, the launch stub can have different geometrical shapes such as, but not limited to, rectangular, spiral (circular, oval, rectangular, and other shapes), or meander shapes; the MTM cell patch can have different geometrical shapes such as, but not limited to, rectangular, spiral (circular, oval, rectangular, and other shapes), or meander shapes; the via pads can have different geometrical shapes and sizes such as, but not limited to, rectangular, circular, oval, polygonal, or irregular shapes; and the gap between the launch stub and the MTM cell patch can take different forms such as, but not limited to, a straight line shape, a curved shape, an L-shape, a meander shape, a zigzag shape, or a discontinued line shape. The via trace that connects the MTM cell to the GND may be located on the top or bottom layer in some implementations. Additional MTM cells may be cascaded in series with the two MTM cells to provide a multi-cell 1D structure, or cascaded in an orthogonal direction generating a 2D structure, or cascaded on top of each other generating a 3D structure. The antenna design in FIGS. 14A-14D may also be implemented in a single-layer structure as described in U.S. patent application Ser. No. 12/250,477 entitled "Single-Layer Metallization and Via-less Metamaterial Structures," filed on Oct. 13, 2008, or in a 3D MTM antenna structure as described in U.S. patent application Ser. No. 12/270,410 entitled "Metamaterial Structures with Multilayer Metallization and Via" and filed on Nov. 13, 2008 (U.S. Publication Ser. No. 2010/0109971), which are incorporated by reference as part of the disclosure of this document. In a single-layer metallization MTM design, each MTM cell can include a cell conductive patch formed on a surface of the substrate, a ground electrode formed on the surface of the substrate and separated from the cell conductive patch, and a conductive line formed on the surface of the substrate to connect the cell conductive patch to the ground electrode. Hence, all components of the MTM cell are formed on the same substrate surface. In the 3D antenna design, antennas may be placed a few millimeters above the substrate or above a ground at certain height. Antennas can be designed to support single or multi-bands. One or more of the above features can be used in an antenna based on the specific requirements for the antenna.

As a specific implementation example for the SFDC MTM antenna shown in FIGS. 14A-14D and FIGS. 15A-15B, two MTM cells with sufficiently different sizes and shapes can be used to construct a SFDC MTM antenna so that the radiating modes generated by one MTM cell are not significantly affected by minor structural changes of the other MTM cell. Such an antenna have the following device parameters: the PCB is made of FR4 with a permittivity of 4.4 and is about 45 mm wide, 80 mm long and 1 mm thick; the antenna has an overall height of about 10 mm above GND and a total length of about 38 mm; the Grounded CPW feed-line is about 1.01 mm wide with a 0.2 mm air-gap on both sides to function as a 50 ohm transmission line for the FR4 PCB substrate; the antenna feed line is about 10 mm in length and 0.8 mm in width; the launch stub is about 20 mm long and 0.4 mm wide; the first cell #1 is substantially 'L' shaped with a total length of about 7.5 mm and a total width of about 6.5 mm; and the second cell #2 is substantially rectangular shaped of about 24 mm in length and 5 mm in width. A 4-mil gap is provided between the first cell #1 and the launch stub and a 6-mil gap is provided between the second cell #2 and the launch stub. The distance between the cell#1 and cell#2 is about 0.2 mm. The via trace grounding cell#1 is about 19.2 mm long in total, and the via trace grounding cell#2 is about 43 mm long in total. Both via traces are bent into certain shapes as shown in FIGS. 14B, 14D, and 15B.

Figure 17:
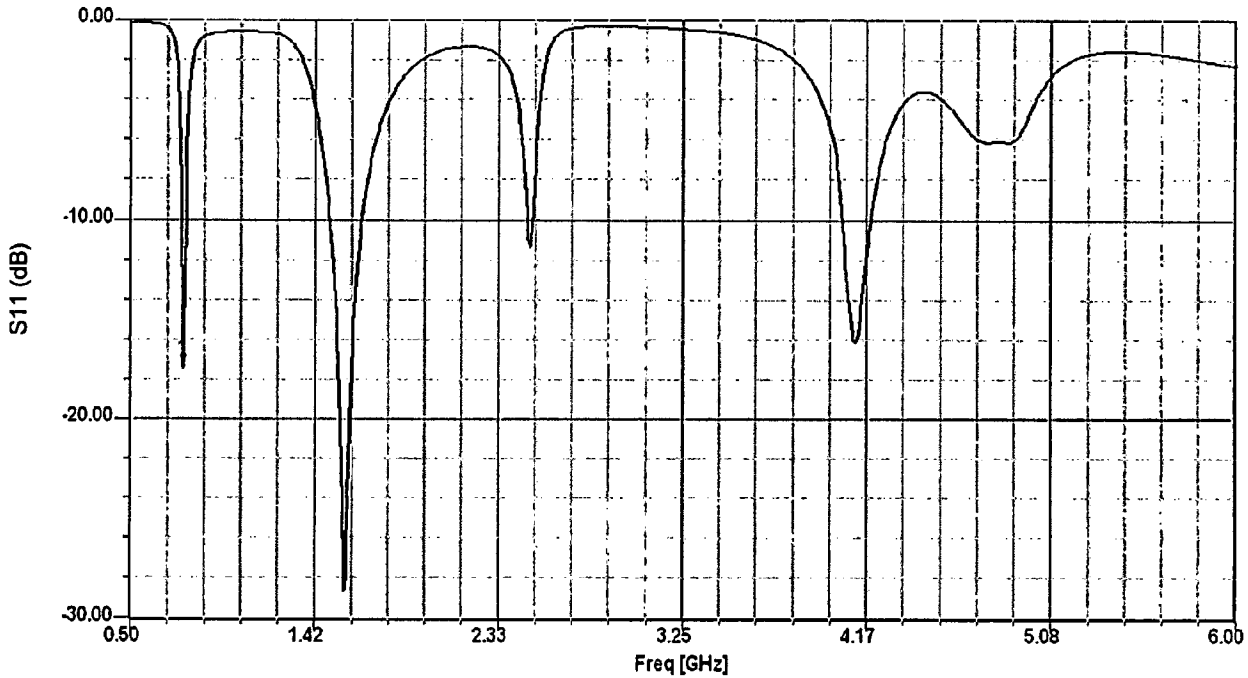
FIG. 17 illustrates the simulated return loss of the single feed multi-cell metamaterial antenna structure of FIGS. 14A-14D.
Figure 18:
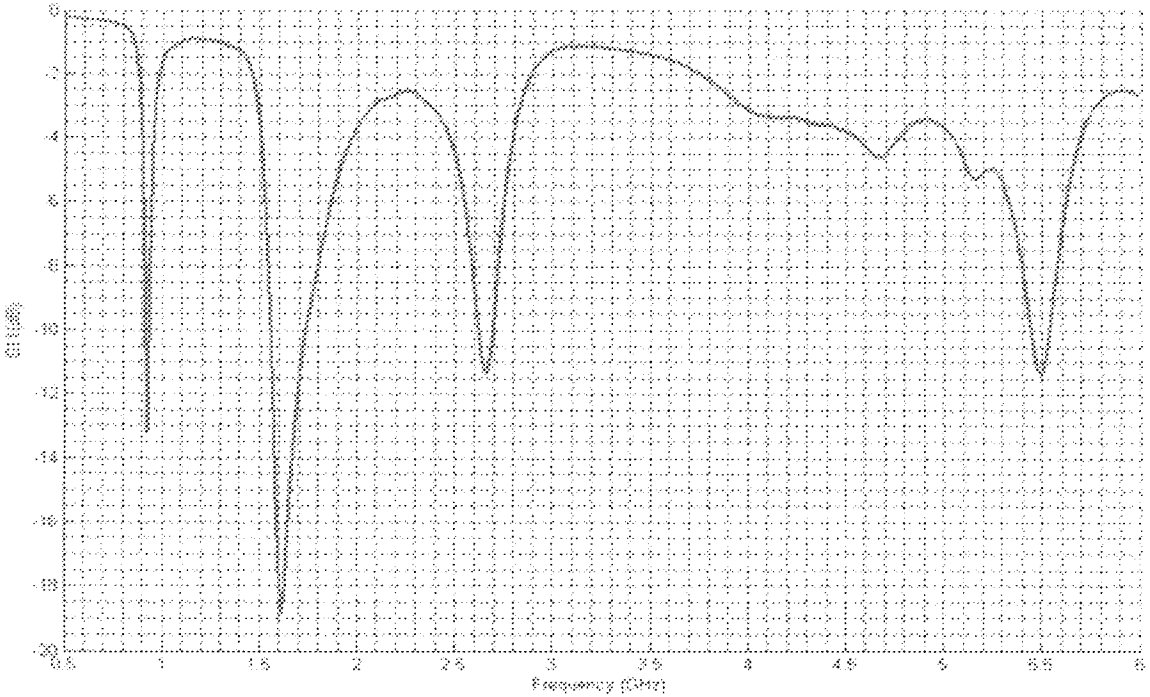
FIG. 18 illustrates the measured return loss of the single feed multi-cell metamaterial antenna structure of FIGS. 15A-15B.

The antenna in this example has four frequency bands as shown in FIG. 17 (simulated) and FIG. 18 (measured).

According to the measurement, the lowest (first) band is approximately centered at 900 MHz with a 32 MHz bandwidth at −6 dB return loss. Factors controlling this band may include the layout of MTM cell#2 and the corresponding via trace. The second band is centered at approximately 1.58 GHz with a 370 MHz bandwidth at −6 dB. Factors controlling this band may include the layout of MTM cell#1 and the corresponding via trace. The distance between cell#1 and cell#2 may directly influence or impact the second resonance. In other words, as two MTM cells are brought closer together, the second resonance can be affected more by the layout of these cells. The third band covers a range of about 2.5 GHz up to 2.7 GHz. The bandwidth for this resonance is about 155 MHz at −10 dB. The fourth band covers a range of about 4 GHz to 6 GHz. The mutual interaction between the two cells can be a factor in controlling the third and fourth bands.

Figure 19:
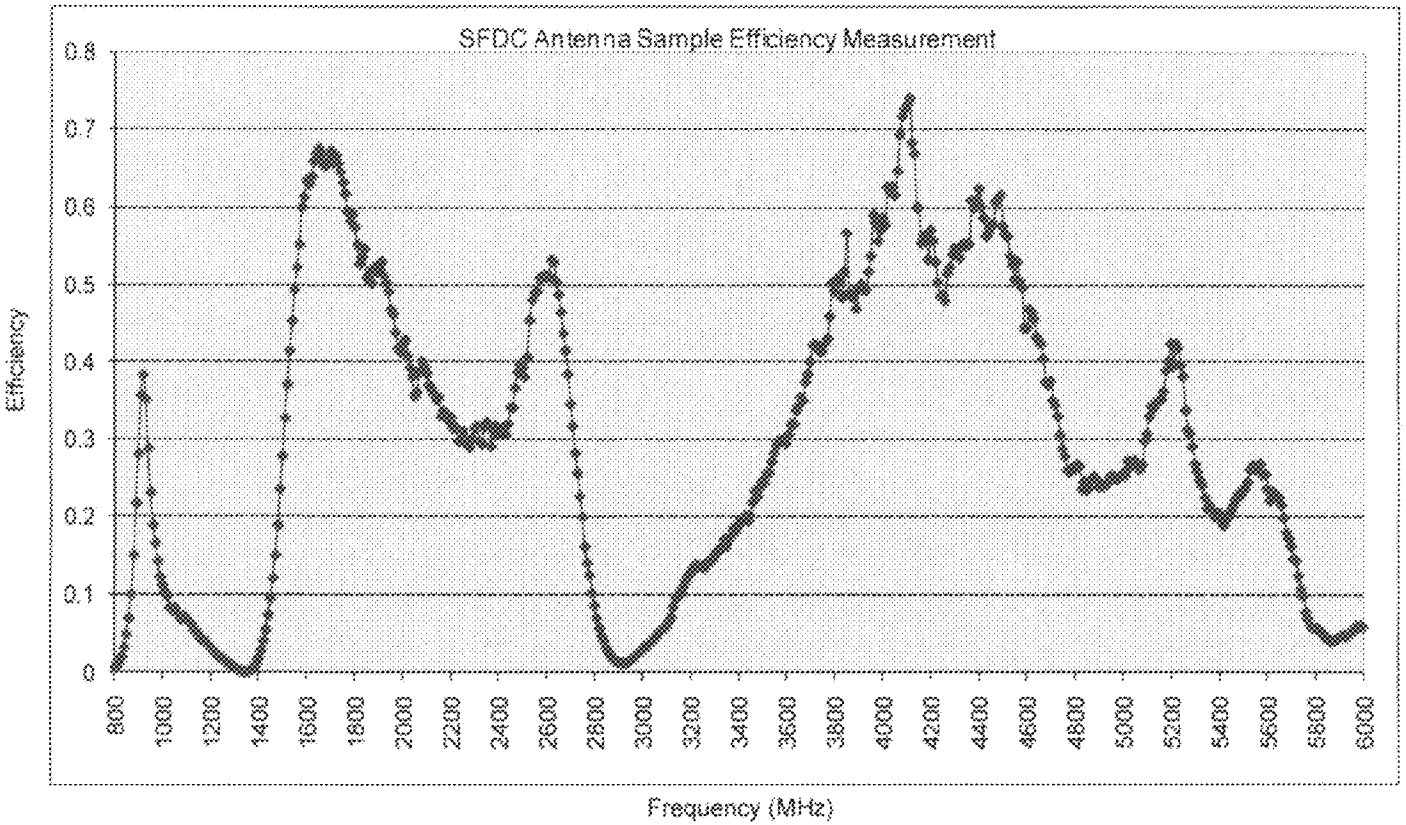
FIG. 19 illustrates the measured efficiency of the single feed multi-cell metamaterial antenna structure of FIGS. 15A-15B.

Efficiency associated with each band can be seen from FIG. 19. The measured efficiency results in this figure indicate radiating modes having good efficiency.

Figure 20A:
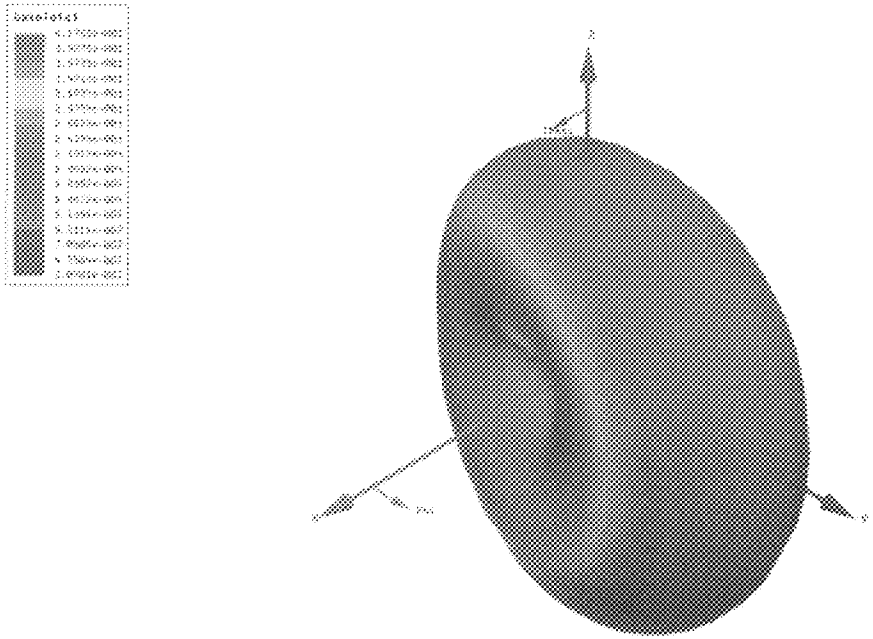

FIG. 20A shows a simulated radiation pattern at 900 MHz, corresponding to the first resonance. As shown in this figure, the radiation is generally directed toward the y direction, which is in the alignment direction of the antenna shown in FIG. 14D.

Figure 20B:
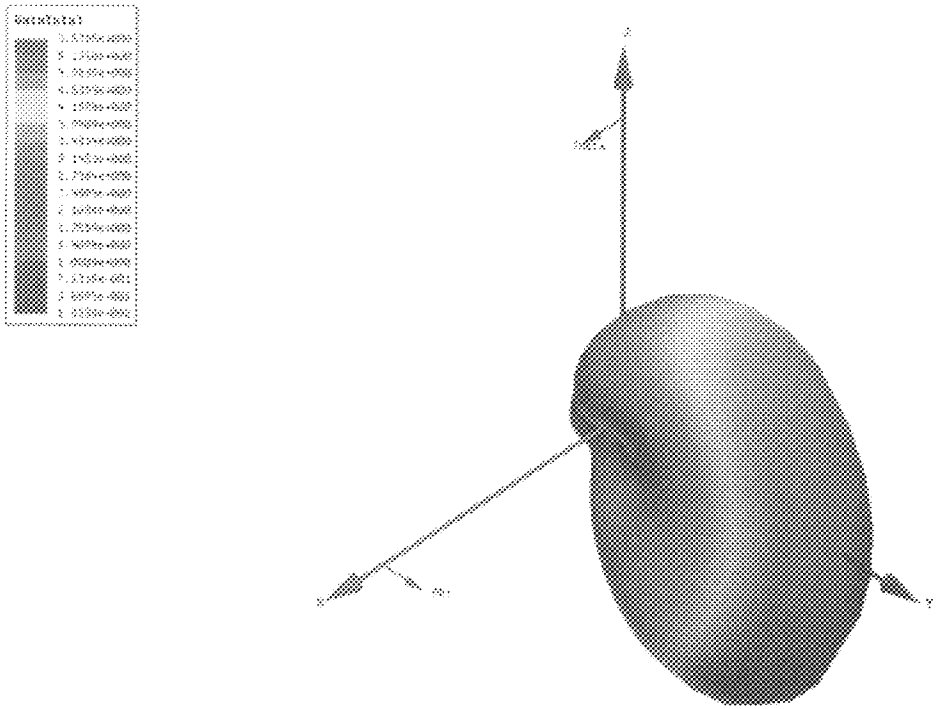

FIG. 20B shows a simulated radiation pattern at 1.575 GHz, corresponding to the second resonance. As shown in this figure, the radiation is generally directed toward the y direction at this resonance as compared with the first resonance shown in FIG. 20A.

FIG. 20C shows a simulated radiation pattern at 2.5 GHz, corresponding to the third resonance. As shown in this figure, the radiation generally has the characteristics of a broadside radiation pattern that is directed toward the ±z directions.

Hence, features and structures described herein can be used to construct antenna structures comprising two or more MTM cells sharing a single launch stub. These antenna structures can generate multiple resonances and can be fabricated by using printing techniques on a double layer PCB. The MTM antenna structures described herein may cover multiple disconnected and connected bands. In some implementations, more than two MTM cells can be fed by a single shared feed line in the similar way as the dual MTM cells to meet more complicated specifications. The structures presented herein can be used to design other RF components such as, but not limited to, filters, power combiners and splitters, diplexers. The structures presented herein can be used to design RF front-end subsystems.

Figure 21A:
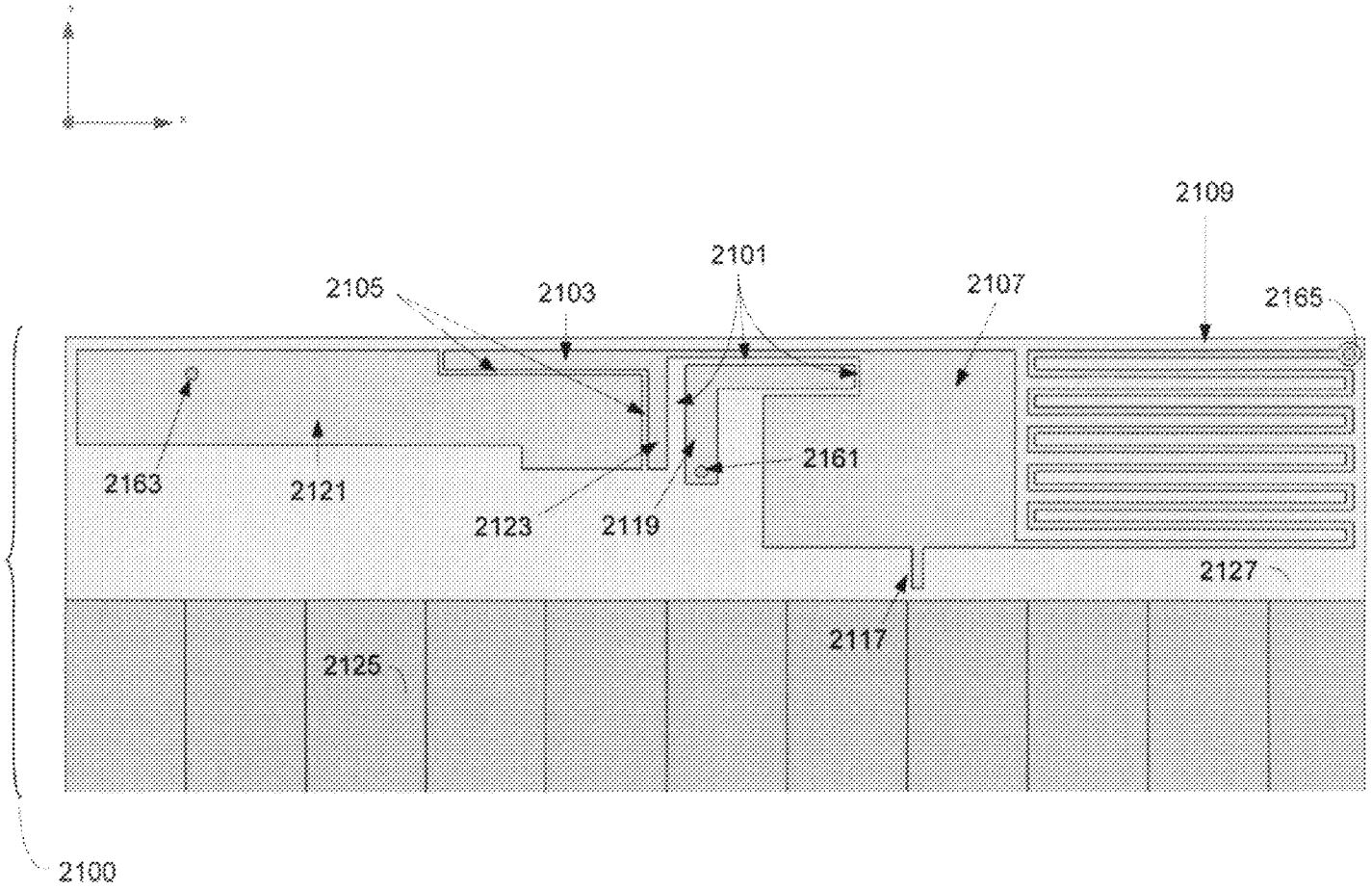
FIGS. 21A-21D illustrate the top view of the top layer, the top view of the bottom layer, the side view, and 3D perspective view, respectively, of an exemplary single feed multi-cell metamaterial pentaband antenna structure.

FIGS. 21A-21D show an implementation of an SFMC MTM antenna design in a Single-Feed Dual-Cell MTM pentaband antenna structure. This design includes a dielectric substrate 2167 having a first surface 2100 on a first side and a second surface 2140 on a second side opposing the first side and two MTM cells. Referring to FIG. 21A, a first cell and second cell conductive patches 2119 and 2121 for the two MTM cells are formed on the first surface 2100 and are separated from each other. In this example, the first cell and second cell conductive patches 2119 and 2121 have different shapes and sizes. A conductive launch pad 2107 is positioned on the first surface 2100 adjacent to both the first and second cell conductive patches 2119 and 2121 and is separated from each of the first and second cell conductive patches 2119 and 2121 by insulation gaps 2101 in order to electromagnetically couple to each of the first and second cell conductive patches 2119 and 2121 to the conductive launch pad 2107. A top ground electrode 2125 is formed on the first surface 2100 and spaced away from the first and second cell conductive patches 2119 and 2121.

The conductive launch pad 2107 may include a first conductive line 2117 to receive a signal from an external launch cable. At a first end, the conductive launch pad 2107 extends into a second conductive line 2103 which directs the signal to the first and second cell conductive patches and 2119 and 2121. The second conductive line 2103 branches into a third conductive line 2123 interposed between and separated from the first and second conductive patches 2119, 2121 by insulation gaps 2105. The third conductive line 2123 aids the electromagnetic coupling between the first and second cell conductive patches 2119 and 2121. At a second end, the conductive launch pad 2107 can be attached to a meandering conductive line 2109 extending to a location away from the first and second conductive patches 2119 and 2121.

In another implementation, the second conductive line 2103 does not branch, and, thus, the third conductive line 2123 is absent. As such, the first conductive cell patch 2119 is positioned adjacent to the second conductive cell patch 2121 by insulating gaps 2105.

Figure 21B:
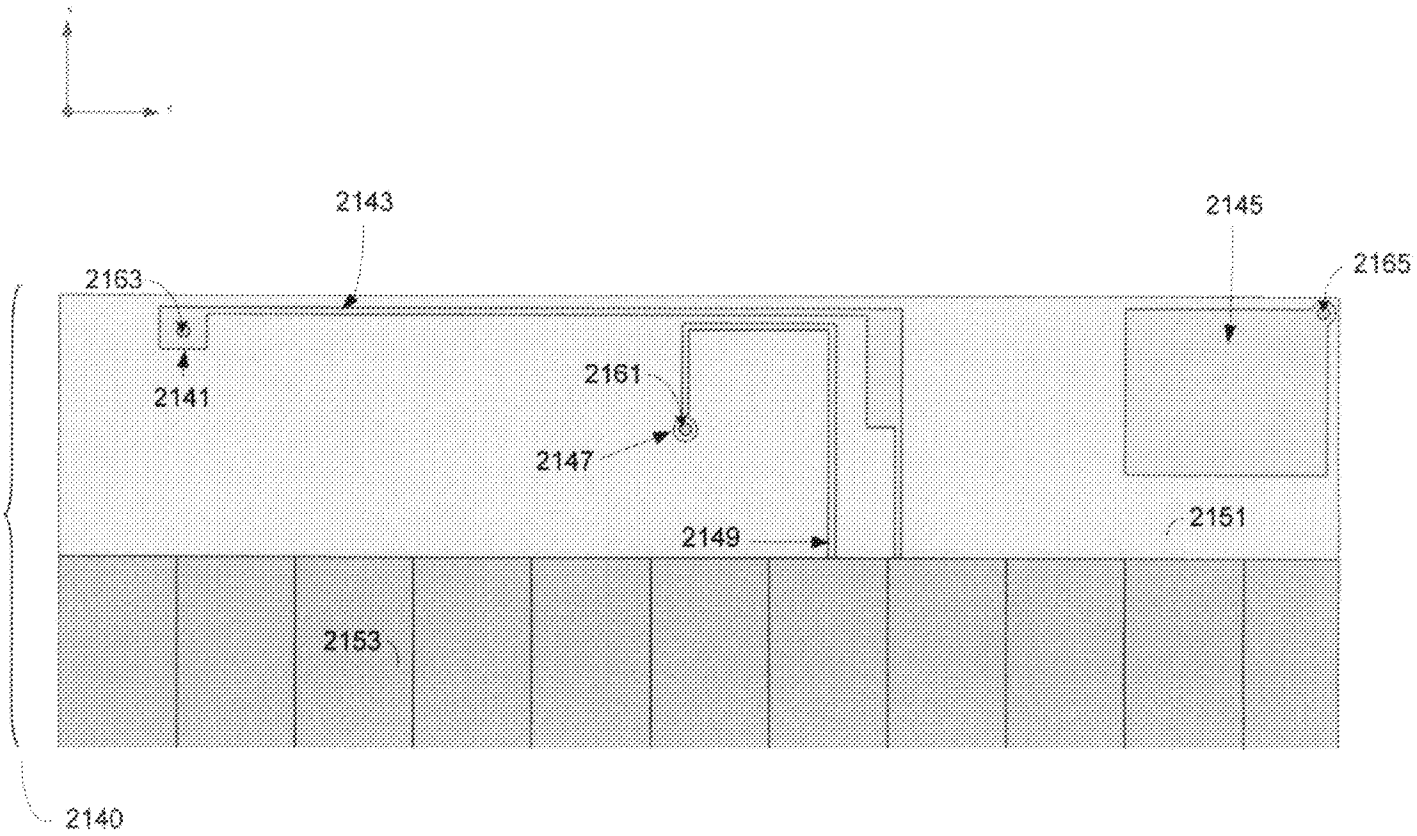
Figure 21C:
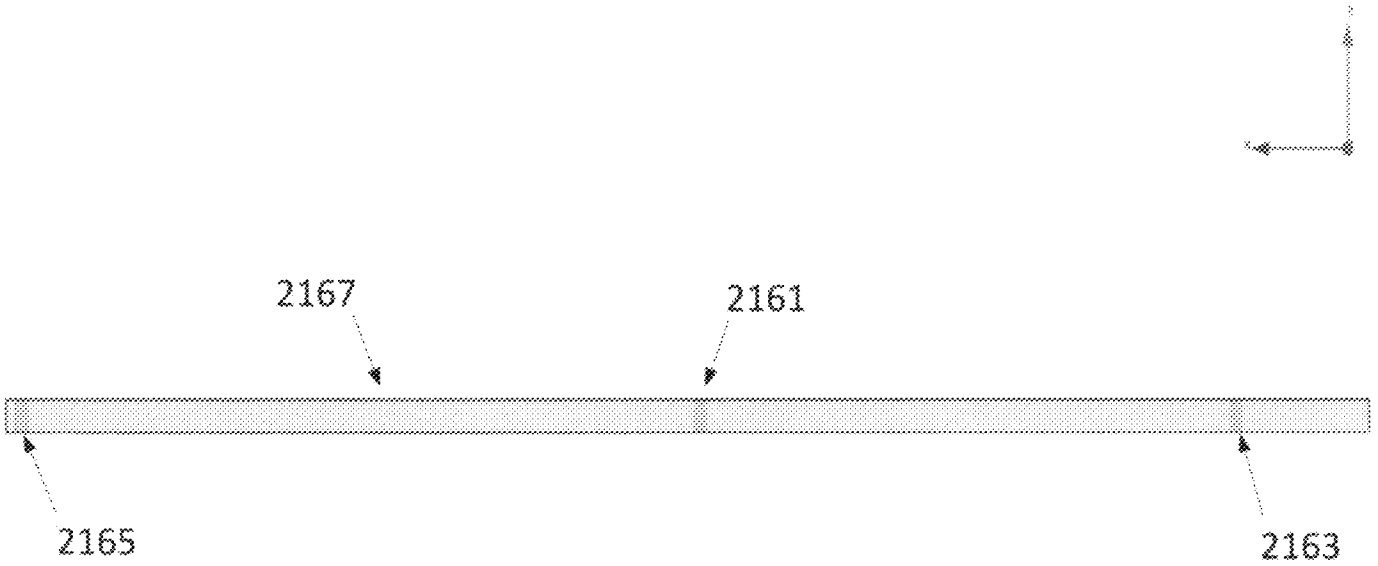

Referring to FIGS. 21A-21C, this design includes a cell ground conductive electrode 2153 formed on the second surface 2140 of the substrate 2167 and located outside the footprints projected by the first and second cell conductive patches 2119 and 2121, and the conductive launch pad 2107 onto the second surface 2140 of the substrate 2167. Also on the second surface 2140 and within a footprint projected by the first cell conductive patch 2119 onto the second surface 2140, there is a first cell conductive via patch 2147. A first cell conductive via connector 2161 is formed in the substrate 2167 to connect the first cell conductive patch 2119 to the first cell conductive via patch 2147.

In addition, the design in FIGS. 21A-21C includes a second cell conductive via patch 2141 formed on the second surface 2140 and in a footprint projected by the second cell conductive patch 2121 onto the second surface 2140. A second cell conductive via patch 2141 is formed on the second surface 2140 and within a footprint projected by the second cell conductive patch 2121 onto the second surface 2140. A second cell conductive via connector 2163 is formed in the substrate 2167 to connect the second cell conductive patch 2121 to the second cell conductive via patch 2141.

The design in FIGS. 21A-21C includes a third conductive via patch 2145 formed on the second surface 2140 and substantially within a footprint projected by the meandering strip line 2109 onto the second surface 2140. A third conductive via connector 2165 is formed in the substrate 2167 to connect the end of the meandering strip line 2109 to the third conductive via patch 2145. Additionally, a first conductive strip line 2149 is formed on the second surface 2140 to connect the first cell conductive via patch 2147 to the cell ground conductive electrode 2153, and a second conductive stripe line 2143 is formed on the second surface 2140 to connect the second cell conductive via patch 2141 to the cell ground conductive electrode 2153.

Figure 21D:
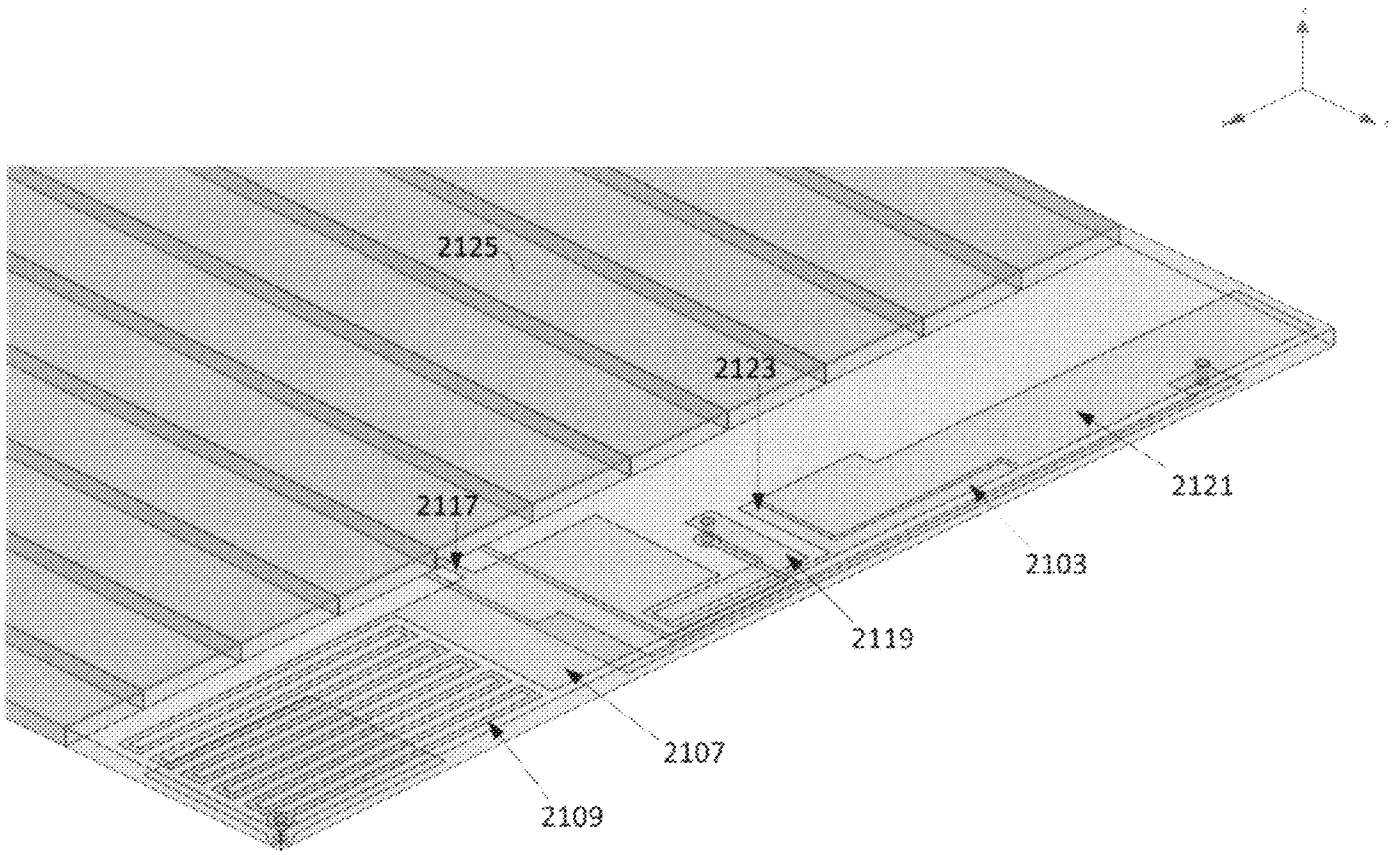

FIG. 21D shows a 3D perspective of the Single-Feed Dual-Cell MTM pentaband antenna structure in FIGS. 21A-21C. The inter-layer relationships between the first and second surfaces 2100 and 2140 are shown to illustrate the relative positioning of components located on the first surface 2100 relative to the components located on the second surface 2140. Elements illustrated in 3D view include the meandering conductive line 2109, conductive launch stub 2107, first cell conductive patch 2119, second conductive line 2103, second conductive cell patch 2121, first conductive line 2117, third conductive line 2123, and the top ground electrode 2125.

Figure 23A:
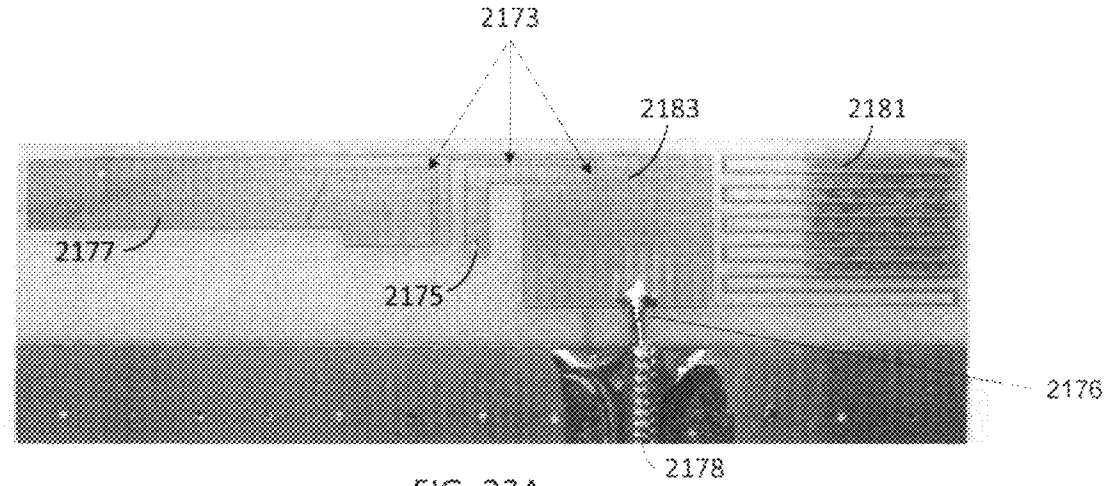
FIGS. 23A-23B illustrate photographs an actual fabricated sample of the top view of the top layer and bottom layer, respectively, of the single feed multi-cell metamaterial pentaband antenna structure illustrated in FIGS. 21A-21B.
Figure 23B:
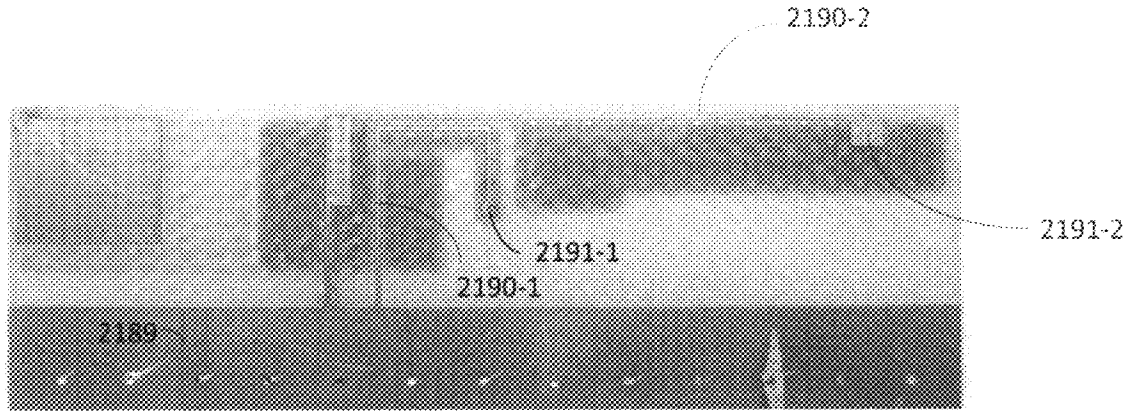

An actual sample fabricated on an FR-4 substrate is shown in FIGS. 23A and 23B. In FIGS. 23A and 23B, a matrix of vias connecting the top ground electrode 1507 and the bottom ground electrode are illustrated. Such via array designs are modeled after the array of slabs shown in FIGS. 21A-21D and are used in this fabricated sample to reduce simulation times where the expected numerical discrepancies are negligible. In FIGS. 23A-23B, the pentaband antenna structure is featured by a single launch pad 2183 feeding two cascading MTM cell patches 2175 and 2177 simultaneously and a meandered conductive line 2181 attached to the conductive launch pad 2183. In this sample, a launch cable 2178 is connected to a first conductive line 2176 which in turn is connected to the launch pad 2183. The feed line described herein may be designed in a variety of ways, and the illustrative embodiment in no way limits one of ordinary skill in the art from implementing alternative designs. For example, other schemes to feed the antenna element can include the use of a grounded CPW line, conventional CPW line without a bottom GND, with a probed patch, or other forms of RF feed lines.

The launch cable 2178 can deliver power to the antenna element through the feed line 2176 and the launch pad 2183. The feed line 2176 can serve as an impedance matching device, delivering power from the launch cable 2178 to the launch pad 2183. Gaps 2173 can be formed between the launch pad 2183 and each of the MTM cells and 2175 and 2177 in different places to electromagnetically couple these elements. The dimension of each gap, which may range between 0.2-0.8 mm, for example, can be different and may also affect the performance of the antenna. Each MTM cell (2175 or 2177) is connected separately to the bottom GND 2189 through a via (2191-1, 2191-2) and a via line (2190-1, 2190-2).

The two cascading MTM cells 2175 and 2177 can be fed in such a way that the electromagnetic coupling between the MTM cell#1 2175 and the launch pad 2183, and that between the MTM cell#2 2177 and the launch pad 2183, are in the same direction. The present design allows for mutual enhancement of the coupling effect, thereby generating efficient radiating modes. These radiating modes can originate from electromagnetic radiation from the individual MTM cells as well as the interaction between the two MTM cells 2175 and 2177. The meandered stub 2181 that stems from the launch pad 2183 may be responsible for the introduction of another efficient mode, allowing this antenna structure to cover an extra band.

Figure 24A:
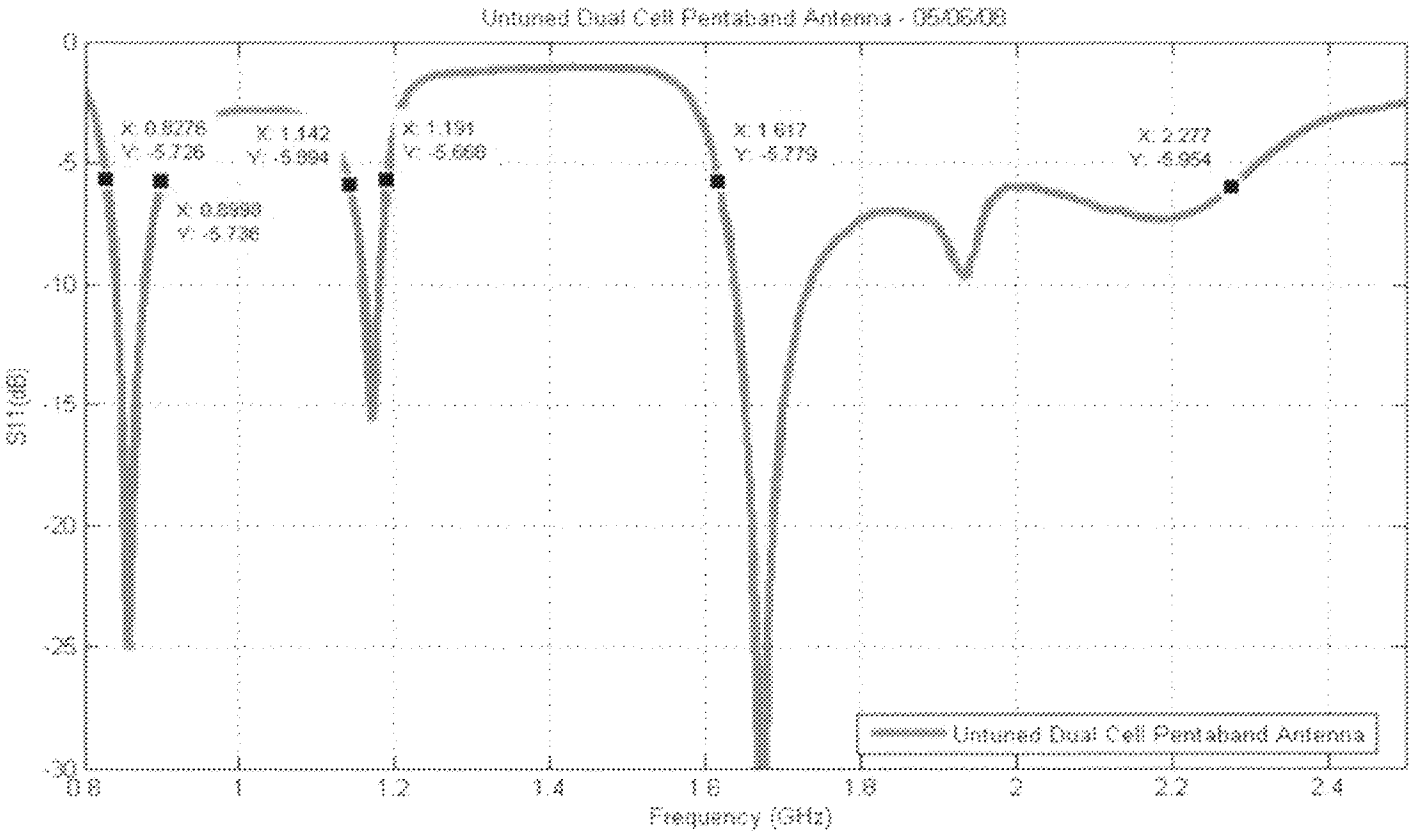
FIGS. 24A-24B illustrate the measured return loss and the measured efficiency, respectively, of the single feed multi-cell metamaterial pentaband antenna structure of FIGS. 23A-23B.
Figure 24B:
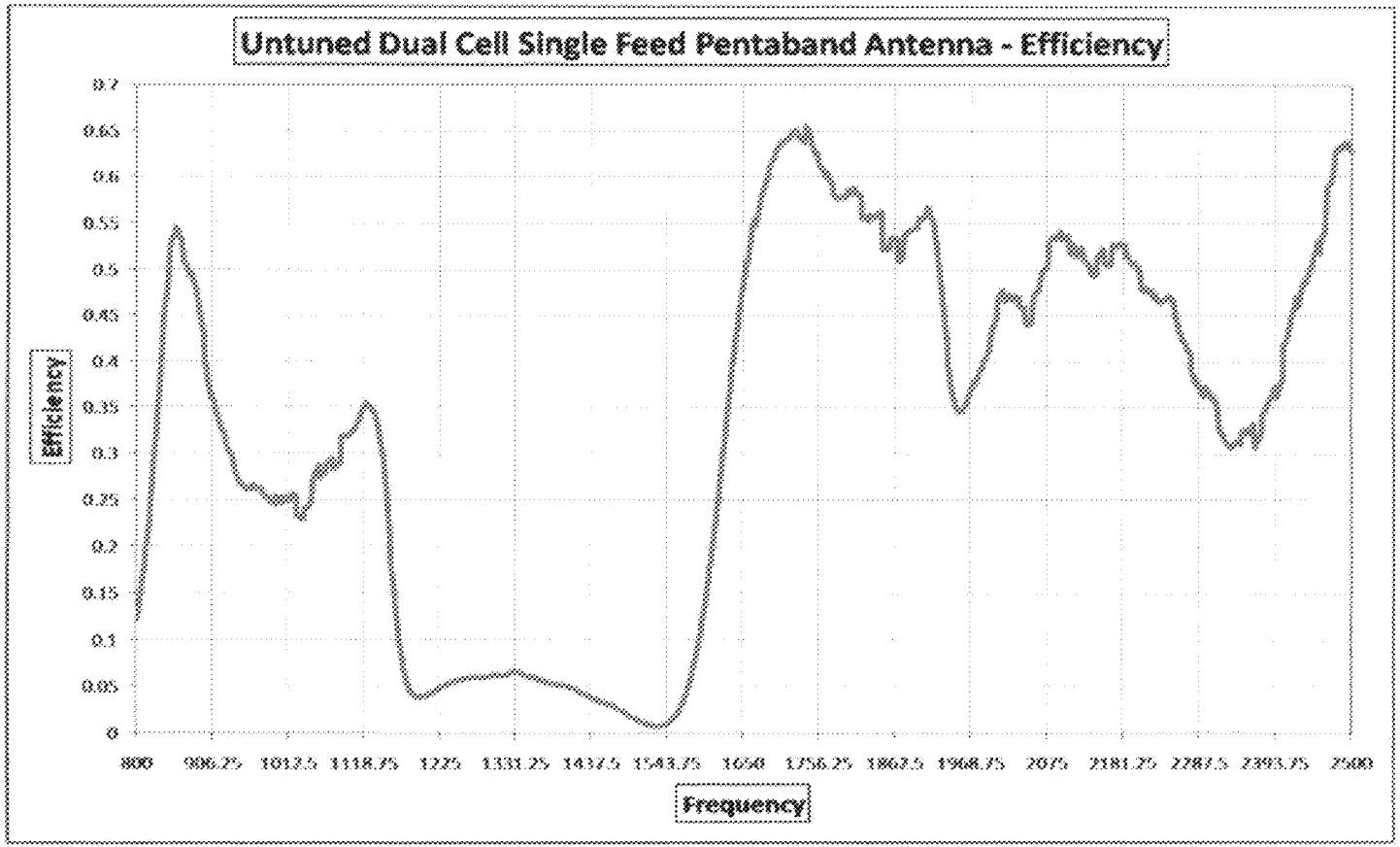

FIGS. 24A-24B illustrate the measured return loss and the measured efficiency, respectively, of the fabricated antenna structure of FIGS. 23A-23B.

The components, description and location of the single-feed dual cell (SFDC) MTM pentaband antenna design described herein are summarized in the Table 2.

TABLE 2

Element parts for SFDC MTM antenna design

| Parameter | Description | Location |
|---|---|---|
| Antenna Element | Comprises two MTM Cells connected to a launch coaxial cable via a Feed Line and a Launch pad. Also, part of the Antenna Element can include a meandered stub that stems from the launch pad. These elements may be located on the top layer of the FR-4 substrate. | Top Layer |
| Feed Line | Connects the Launch Pad with the launch coaxial cable. | Top Layer |
| Launch Stub | Delivers electromagnetic energy to each of the two MTM cells by coupling over a slim gap and to the meandered stub. | Top Layer |

TABLE 2-continued

Element parts for SFDC MTM antenna design

| Parameter | Description | | Location |
|---|---|---|---|
| Meandered Stub | Stems from the launch pad drawing current from it to generate an efficient extra resonant mode. | | Top Layer |
| MTM Cells | Cell Patch | One is substantially L shaped; the other is substantially rectangular shaped. | Top Layer |
| | Via | Cylindrical shape connecting each the cell patches with a of corresponding Via Pad. | |
| | Via Pad | Pad that connects the bottom part of the Via to a corresponding Via Trace | Bottom Layer |
| | Via Trace | A thin trace connected to the via pad that connects the corresponding MTM cell to the bottom GND. | Bottom Layer |

When the structure of each cell is altered, the meandered stub and various other parts may affect the resonance and matching of multiple modes. In particular, the antenna resonances can be affected by the presence of the left handed mode. In general, the left handed mode helps excite and better match the lowest resonance as well as improves the matching of higher resonances.

The above design can be implemented in various configurations. For example, the launch stub can have different geometrical shapes such as, but not limited to, rectangular, spiral (circular, oval, rectangular, and other shapes), or meander shape; the MTM cell patch can have different geometrical shapes such as, but not limited to, a rectangular shape, a spiral shape (e.g., circular, oval, rectangular, and other shapes), or meander shape; the meandered stub can have different geometrical shapes such as, but not limited to, rectangular or spiral (circular, oval, rectangular, and other shapes) and can be placed in the top or bottom layers, or a few millimeters above the structure; and the via pads can have different geometrical shapes such as, but not limited to, rectangular, polygonal, or irregular with different sizes. The gap between the launch stub and the MTM cell patch can take different forms such as, but not limited to, straight line, curved, L-shape, meander, zigzag, or discontinued line. The via trace that connects the MTM cell to the GND can be located on the top or bottom layer, and be routed or meandered in different ways. The antennas described herein can be placed a few millimeters above the substrate or above a ground at certain height. Additional MTM cells may be cascaded in series with the two MTM cells to form a multi-cell 1D structure, cascaded in an orthogonal direction to form a 2D structure, or cascaded on top of each other to form a 3D structure. The antennas described herein can be designed to support single or multi-bands.

Figure 25A:
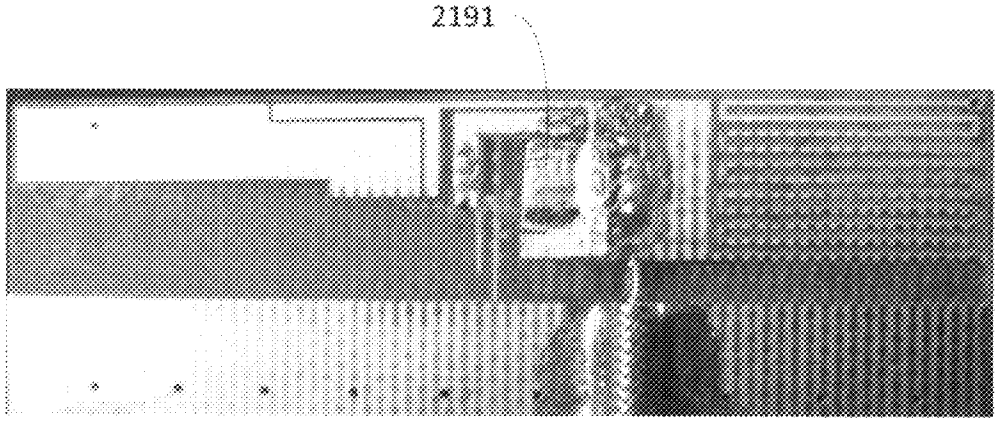
FIGS. 25A-25B illustrate photographs an actual fabricated "Tuned" sample of the top view of the top layer and bottom layer, respectively, of a single feed multi-cell metamaterial pentaband antenna structure.
Figure 25B:
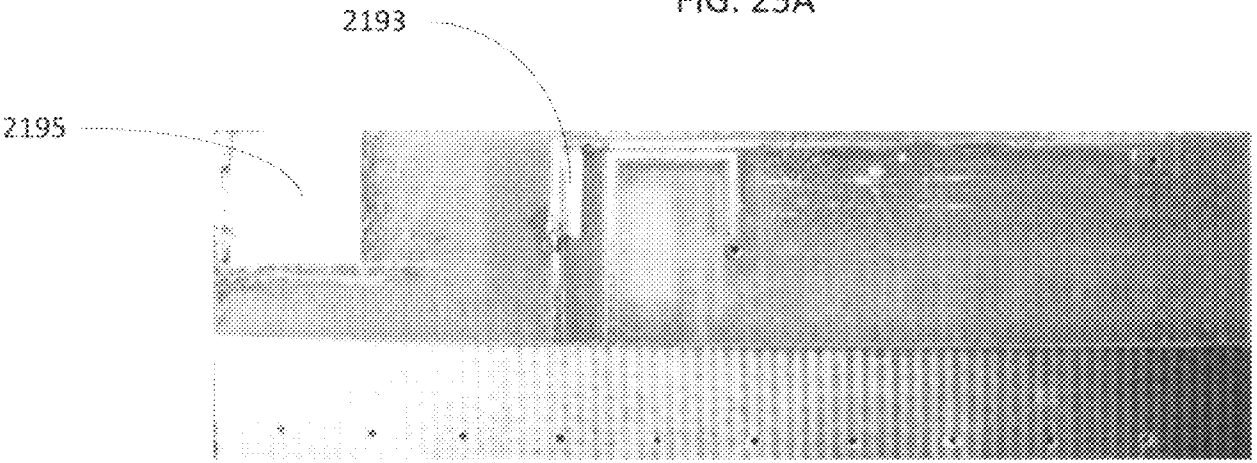
Figure 26A:
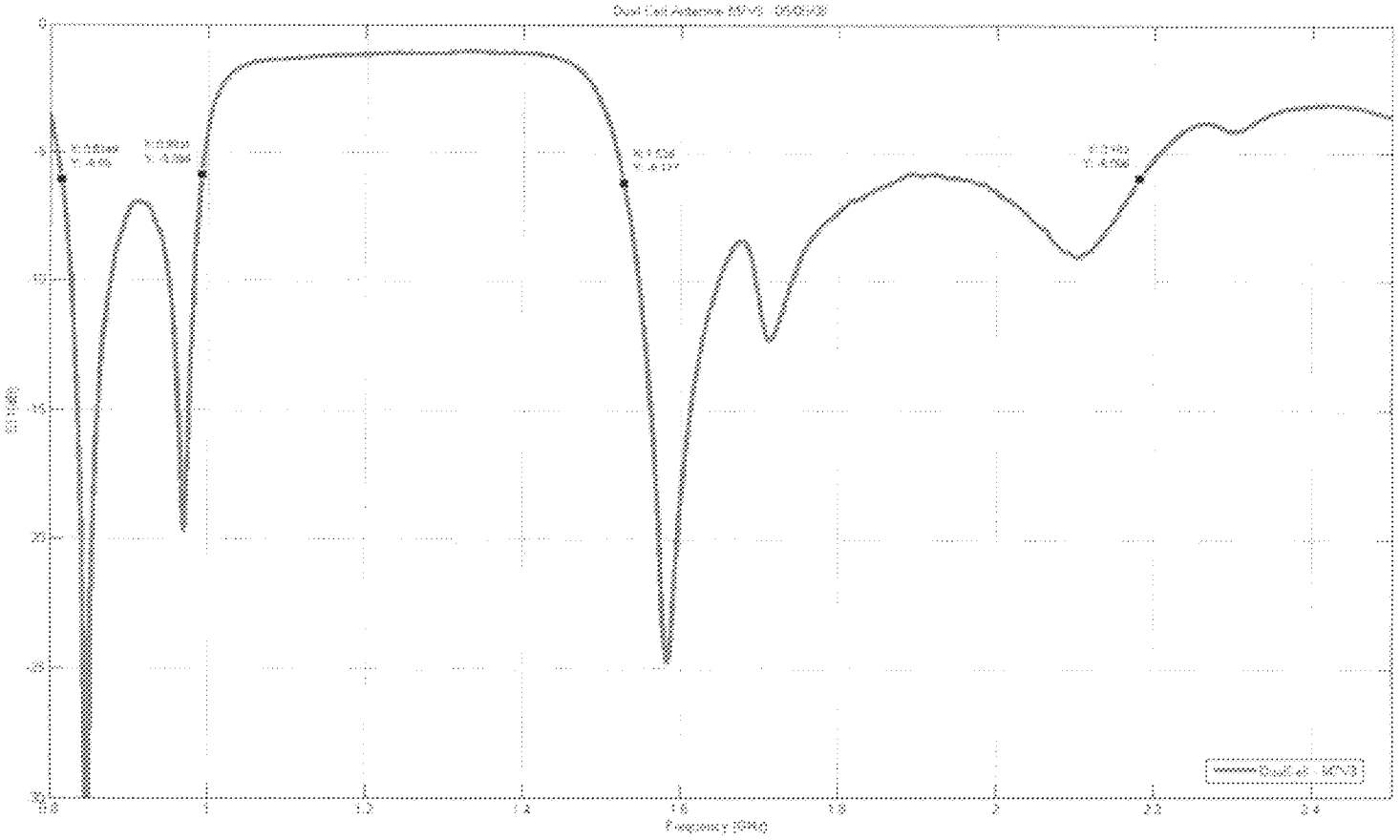
FIGS. 26A-26B illustrate the "Tuned" measured return loss and the "Tuned" measured efficiency, respectively, of the fabricated "Tuned" sample of the single feed multi-cell metamaterial pentaband antenna structure shown in FIGS. 25A-25B.
Figure 26B:
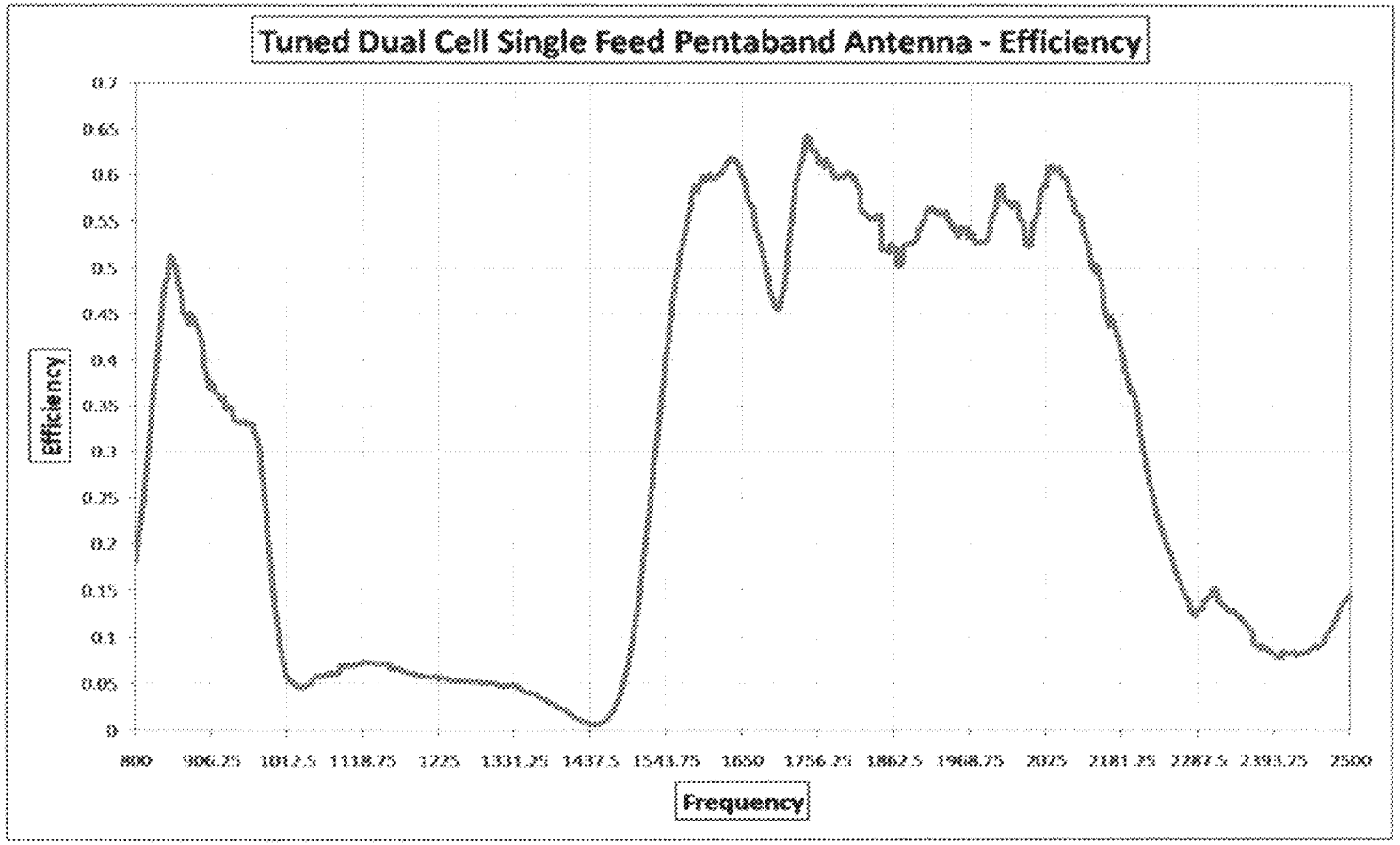

In the example given below, two MTM cells can have sufficiently different size and shape, thus the radiating modes generated by one cell may not be significantly affected by minor structural changes of the other MTM cell. Also, the meandered stub resonance may be present when matched corrected in which the resonant mode of meandered stub can be identified and tuned. FIGS. 25A-25B illustrates a fabricated sample of a tuned antenna structure wherein the components in the tuned fabricated antenna design are identical to that of untuned sample shown in FIGS. 23A-23B. However, in the tuned fabricated antenna sample, copper strips can be selectively added to components in order to lower resonant frequencies. For example, FIGS. 25A-25B illustrates a first copper strip 2191 added to the launch pad, a second copper strip 2193 added to the second conductive line, and a third copper strip 2195 added to the third conductive via patch. The tuned measured return loss and the tuned measured efficiency of the fabricated sample are shown in FIG. 26A and FIG. 26B, respectively. Analysis and comparison of these results to simulated and untuned samples are presented in the next section.

Listed below are a few examples of design parameters used for implementing the SFDC MTM pentaband antenna design as illustrated in FIGS. 21A, 23A, and 25A:

The size of the PCB is approximately 54 mm wide, 90 mm long, and 1 mm thick. The material may be comprised of FR4 with permittivity of 4.4.

The overall height of antenna is approximately 10.5 mm above GND, and its total length is approximately 53 mm.

The antenna feed line is approximately 1.7 mm in length and 0.5 mm in width. The launch pad can have different widths at different parts of the antenna and can have a total length of about 28.2 mm.

Cell#1 is substantially 'L' shaped. The longer "leg" has a width of about 1 mm and a length of about 5.7 mm; the other leg has a width of about 1.3 mm and a length of about 4 mm. A 0.25 mm gap lies between the longer leg and the launch pad and a 0.8 mm gap lies between the shorter leg and the launch pad.

Cell#2 is substantially rectangular shaped, and is about 23.5 mm in length and about 4 mm in width. A 0.2 mm gap lies between cell#2 and the launch pad.

The distance between cell#1 and cell#2 is approximately 1.8 mm with an extension of the launch pad in between to aid in the electromagnetic coupling.

The meandered stub has an overall length of approximately 154 mm on the top layer and it continues on the bottom layer with a rectangular patch of about 8.5 mm in length and about 7 mm in width.

The via trace grounding cell#1 is approximately 20.9 mm long in total, and via trace grounding cell#2 is about 41.85 mm long in total. Both via traces have a width of approximately 0.3 mm and are bent into certain shapes as shown in FIGS. 21B, 21D, 23B and 25B.

Figure 22:
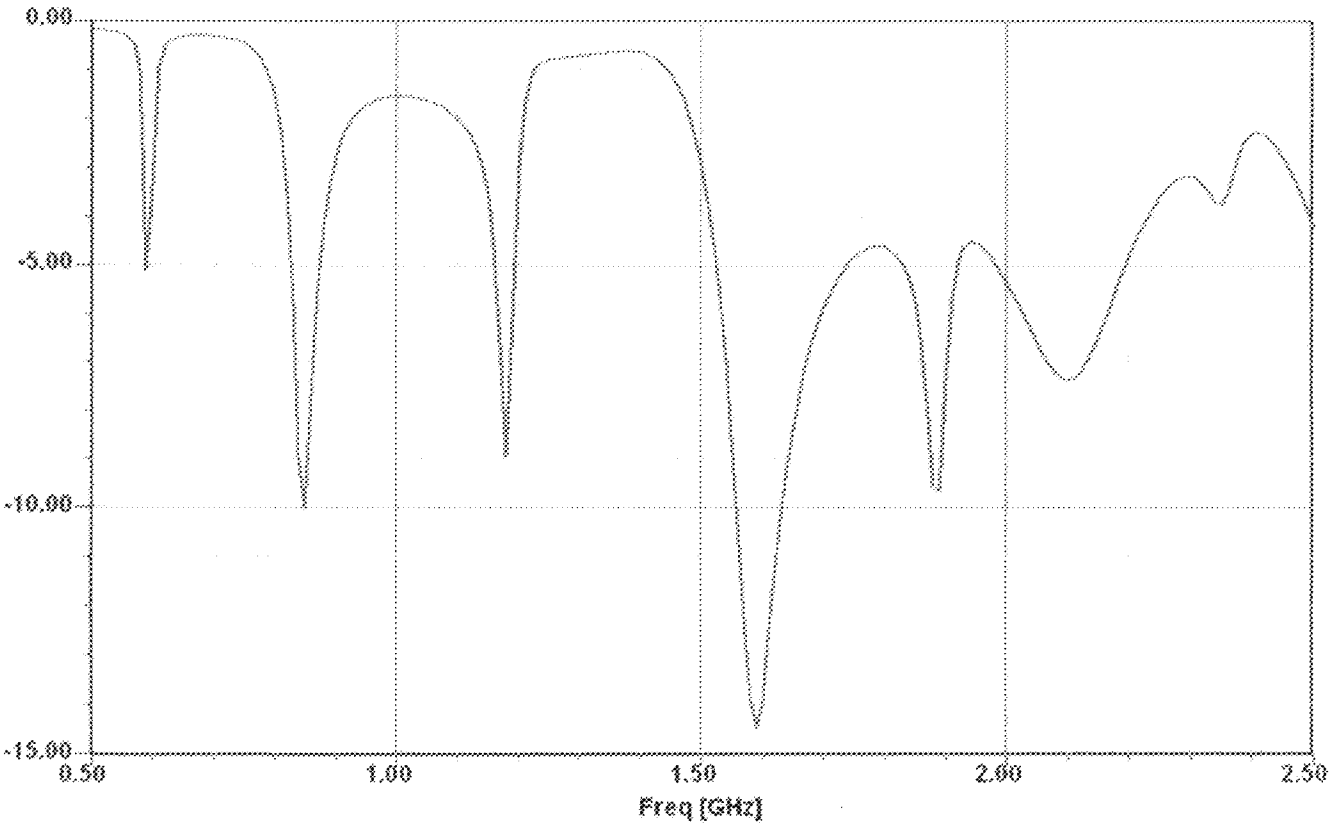
FIG. 22 illustrates simulated return loss of the single feed multi-cell metamaterial pentaband antenna structure of FIGS. 21A-21.

The antenna in this example has five frequency bands as shown in FIG. 22 (simulated), FIG. 24A (untuned measured) and FIG. 26A (tuned measured). In each of these figures, an extra mode may be counted. However, this extra mode is likely due to the closing in of harmonics belonging to the main modes. Depending on the interaction of the antenna element generating it and the rest of the antenna elements, the mode may be efficient or inefficient. In this antenna example, the mode is efficient.

According to the measurement of the untuned sample shown in FIG. 24A, the lowest (first) resonance is centered at about 860 MHz with a 72 MHz bandwidth at about −6 dB return loss. Factors controlling this resonance may include the layout of MTM cell#2, the corresponding via trace and the gap between the cell and the launch pad. The second resonance is centered at about 1.17 GHz with a 25 MHz bandwidth at about −6 dB. Factors controlling this resonance may include the meandered stub length and the relative position it stems from the launch pad. The third resonance shown in FIG. 24A is centered at about 1.67 GHz, and may be controlled by the layout of MTM cell#1, the corresponding via trace and the gap between the cell and the launch pad. As shown in FIG. 24A, the bandwidth of this resonance is approximately 180 MHz. The results depicted in FIG. 24A can attributed to the resonance being merged with the RH resonance of cell#2, hence creating a very wide resonance that covers three higher frequency cellular phone bands. This "high band" of the antenna structure ranges from about 1.62 GHz to 2.25 GHz in the untuned sample.

To cover all five cellular phone bands, the second resonance generated by the meandered stub may be controlled in frequency as seen in the tuned sample shown in FIG. 26A. In this example, the antenna structure is shown to have two major bands: a "low" band and a "high" band covering a range of about 815 MHz to 990 MHz and a range of about 1.5 GHz to 2.18 GHz, respectively. Also, the distance between cell#1 and cell#2 may impact the third resonance. In other words, as the two MTM cells are brought closer together, this reduction in spacing between the two cells may have an increased affect on the third resonance.

Efficiency associated with each band can be seen from FIGS. 24B and 26B for the untuned and tuned samples, respectively. The measured efficiency results in this figure indicate that radiating modes shown have good efficiency.

Hence, antenna designs described herein can be used to fabricate antenna structures comprising two MTM cells, one launch pad, and a meandered stub to cover different cellular phone bands. These antenna structures can generate multiple resonances and can be fabricated using printing techniques on a double layer PCB.

In sum, untuned and tuned examples of SFDC MTM pentaband antennas covering multiple disconnected and connected bands are presented hereinabove. Other implementations can be extended to the following applications:

More than two MTM cells can be fed by a single shared feed line in the similar way as the dual MTM cells to meet more complicated specifications.

The structures presented herein can be used to design other RF components such as, but not limited to, filters, power combiners and splitters, diplexers, and RF front-end subsystems.

While this document contains many specifics, these should not be construed as limitations on the scope of any invention or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments have been described. Variations and enhancements of the described embodiments, and other embodiments can be made based on what is described and illustrated.

What is claimed is:

1. A Composite Right-Left Handed (CRLH) metamaterial (MTM) antenna device, comprising:

a substrate;

a plurality of MTM cells formed on the substrate, each MTM cell comprising a cell conductive patch formed on a first surface of the substrate and a cell conductive via formed in the substrate and conductively coupled to the cell conductive patch;

a conductive launch stub formed on the substrate to be adjacent to at least a portion of a lateral edge of the cell conductive patch of each of the MTM cells and electromagnetically coupled to each of the MTM cells; and a ground electrode formed on the second surface of the substrate, the ground electrode entirely outside a footprint of the respective cell conductive patches projected from the first surface onto the second surface, wherein a first of the plurality of MTM cells comprises an L-shaped cell conductive patch and a second of the plurality of MTM cells comprises a rectangularly-shaped cell conductive patch having a linear recess in one side; and wherein the cell conductive patch of each of the MTM cells is coupled to the ground electrode using at least one conductive line located on the second surface of the substrate, the at least one conductive line conductively coupled to the cell conductive via of each of the MTM cells.

2. The device as in claim 1, comprising:

a meandering conductive line coupled to the conductive launch stub.

3. The device as in claim 1, wherein:

each MTM cell comprises a cell conductive via patch formed on the second surface of the substrate opposing the first surface, wherein each cell conductive via formed in the substrate conductively couples a respective cell conductive patch to a respective cell conductive via patch, and wherein the at least one conductive line comprises a plurality of conductive via lines including a respective conductive via line included as a portion of each MTM cell, the respective conductive via line formed on the second surface to conductively couple a respective cell conductive via patch to the ground electrode.

4. The device as in claim 3, wherein:

in each MTM cell, the cell conductive via patch includes at least one dimension that is smaller than a corresponding dimension of the cell conductive patch.

5. The device as in claim 1, wherein:

the MTM cells and the conductive launch stub are structured to collectively provide an antenna structure having two or more resonance frequencies.

6. The device as in claim 1, wherein:

each MTM cell comprises a cell conductive via patch formed on the second surface of the substrate opposing the first surface, and wherein the at least one conductive line includes a conductive line formed on the second surface to conductively couple each cell conductive patch to the ground electrode using the cell conductive via and the cell conductive via patch of each MTM cell.

7. A Composite Right-Left Handed (CRLH) Metamaterial (MTM) antenna device, comprising:

a dielectric substrate having a first surface on a first side and a second surface on a second side opposing the first side;

a first cell conductive patch formed on the first surface;

a second cell conductive patch formed on the first surface and adjacent to the first cell conductive patch by an insulation gap;

a shared conductive launch stub formed on the first surface adjacent to at least a portion of a lateral edge of both the first and second cell conductive patches and separated from each of the first and second cell conductive patches by an insulation gap to be electromagnetically coupled to each of the first and second cell conductive patches, the shared conductive launch stub comprising an extended strip line configured to direct a signal to the first and second cell conductive patches and configured to receive signals from the first and second cell conductive patches;

a cell ground conductive electrode formed on the second surface and located entirely outside footprints projected by the first and second cell conductive patches onto the second surface;

a first cell conductive via patch formed on the second surface and in a footprint projected by the first cell conductive patch onto the second surface;

a first cell conductive via connector formed in the substrate to connect the first cell conductive patch to the first cell conductive via patch;

a second cell conductive via patch formed on the second surface and in a footprint projected by the second cell conductive patch onto the second surface;

a second cell conductive via connector formed in the substrate to connect the second cell conductive patch to the second cell conductive via patch;

a first conductive strip line formed on the second surface to connect the first cell conductive via patch to the cell ground conductive electrode; and a second conductive strip line formed on the second surface to connect the second cell conductive via patch to the cell ground conductive electrode, wherein the first cell conductive patch comprises an L-shaped cell conductive patch and the second cell conductive patch comprises a rectangularly-shaped cell conductive patch having a linear recess in one side.

8. The device as in claim 7, comprising:

a first cell ground conductive electrode formed on the first surface and spaced away from the first and second cell conductive patches, the first cell ground conductive electrode patterned to include co-planar waveguide that has a first terminal and a second terminal, wherein the extended strip line of the shared conductive launch stub is connected to the second terminal.

9. A Composite Right-Left Handed (CRLH) Metamaterial (MTM) antenna device, comprising:

a dielectric substrate having a first surface on a first side and a second surface on a second side opposing the first side;

a first cell conductive patch formed on the first surface;

a second cell conductive patch formed on the first surface and separated from the first cell conductive patch;

a conductive launch stub formed on the first surface adjacent to at least a portion of a lateral edge of both the first and second cell conductive patches and separated from each of the first and second cell conductive patches by an insulation gap to be electromagnetically coupled to each of the first and second cell conductive patches, the conductive launch stub comprising:

a first conductive line to receive a signal from an external launch cable;

a second conductive line extending from a first end of the conductive launch stub, the second conductive line guiding the signal to the first and second cell conductive patches;

a meandering conductive line extending from the second end of the conductive launch stub to a location away from the first and second conductive patches;

a cell ground conductive electrode formed on the second surface and located entirely outside footprints projected by the first and second cell conductive patches, and the conductive launch stub onto the second surface;

a first cell conductive via patch formed on the second surface and in a footprint projected by the first cell conductive patch onto the second surface;

a first cell conductive via connector formed in the substrate to connect the first cell conductive patch to the first cell conductive via patch;

a second cell conductive via patch formed on the second surface and in a footprint projected by the second cell conductive patch onto the second surface;

a second cell conductive via connector formed in the substrate to connect the second cell conductive patch to the second cell conductive via patch;

a third conductive via patch formed on the second surface and in substantially a footprint projected by the meandering conductive line onto the second surface;

a third conductive via connector formed in the substrate to connect the end of the meandering conductive line to the third conductive via patch;

a first conductive strip line formed on the second surface to connect the first cell conductive via patch to the cell ground conductive electrode; and a second conductive strip line formed on the second surface to connect the second cell conductive via patch to the cell ground conductive electrode, wherein the first cell conductive patch comprises an L-shaped cell conductive patch and the second cell conductive patch comprises a rectangularly-shaped cell conductive patch having a linear recess in one side.

10. The device as in claim 9, comprising:

a third conductive line interposed between and separated from the first and second cell conductive patches by an insulation gap to aid the electromagnetic coupling between the first and second cell conductive patches.

11. The device as in claim 9, wherein:

the first and second cell conductive patches include at least one respective dimension that differs between the first and second cell conductive patches.

12. The device of claim 1 wherein the plurality of MTM cells comprise two cascading MTM cells fed in such a way that the electromagnetic coupling between the two cascading MTM cells and the launch stub is in the same direction.

13. The device of claim 8 wherein the electromagnetic coupling between the first cell conductive patch and the second cell conductive patch, and the launch stub, is in the same direction.

14. A Composite Right-Left Handed (CRLH) metamaterial (MTM) antenna device, comprising:

a substrate;

a plurality of MTM cells formed on the substrate, each MTM cell comprising a cell conductive patch formed on a first surface of the substrate and a cell conductive via formed in the substrate and conductively coupled to the cell conductive patch;

a conductive launch stub formed on the substrate to be adjacent to at least a portion of a lateral edge of the cell conductive patch of each of the MTM cells and electromagnetically coupled to each of the MTM cells; and a ground electrode formed on the second surface of the substrate, the ground electrode entirely outside a footprint of the respective cell conductive patches projected from the first surface onto the second surface, wherein a first of the plurality of MTM cells comprises a rectangularly-shaped cell conductive patch having a linear recess in each of two sides of the rectangularly-shaped cell conductive patch and a second of the plurality of MTM cells comprises an L-shaped cell conductive patch; and wherein the cell conductive patch of each of the MTM cells is coupled to the ground electrode using at least one conductive line located on the second surface of the substrate, the at least one conductive line conductively coupled to the cell conductive via of each of the MTM cells.

* * * * *

UNITED STATES PATENT AND TRADEMARK OFFICE

CERTIFICATE OF CORRECTION

PATENT NO. : 9,190,735 B2
APPLICATION NO. : 12/408642
DATED : November 17, 2015
INVENTOR(S) : Xu et al.

It is certified that error appears in the above-identified patent and that said Letters Patent is hereby corrected as shown below:

Title Page, item (56), on page 2, in column 2, under "Other Publications", line 16, delete "2010-7023139," and insert --2010-7023189,--, therefor In the Claims In column 24, line 1, in Claim 13, delete "8" and insert --7--, therefor Signed and Sealed this
Twenty-eighth Day of June, 2016

Michelle K. Lee

Michelle K. Lee
*Director of the United States Patent and Trademark Office*